US005791147A

United States Patent [19]

Earley et al.

[11] Patent Number: 5,791,147

[45] Date of Patent: Aug. 11, 1998

[54] POWER PLANT PERFORMANCE MANAGEMENT SYSTEMS AND METHODS

[75] Inventors: James N. Earley, Rockdale; Jeffrey D. Hooper, Lexington; Billy H. Stigall, Thorndale; John S. Stinson, Rockdale, all of Tex.

[73] Assignee: Basic Resources, Inc., Dallas, Tex.

[21] Appl. No.: 739,140

[22] Filed: Oct. 28, 1996

[51] Int. Cl.[6] ..... F01K 13/02

[52] U.S. Cl. ..... 60/646; 60/657; 165/11.1; 364/509

[58] Field of Search ..... 60/646, 657, 660, 60/676, 678; 165/11.1; 364/509

[56] References Cited

U.S. PATENT DOCUMENTS

| | | | |
|---|---|---|---|
| 4,410,950 | 10/1983 | Toyoda et al. | 364/551 |
| 5,012,429 | 4/1991 | Lantz | 364/509 |
| 5,353,653 | 10/1994 | Watanabe et al. | 165/11.1 |

*Primary Examiner*—Noah P. Kamen

*Attorney, Agent, or Firm*—R. Darryl Burke; Worsham, Forsythe & Wooldridge

[57] ABSTRACT

A steam powered electric power generating station to provide electricity comprises a steam turbine positioned in a steam turbine shell, equipment, such as a heater, a first and a second temperature detectors, and a computer. The steam turbine has necessary blades and a shaft to turn an electrical generator to create electricity. The steam turbine shell mechanically coupled to receive steam to turn the at least one blade steam turbine. The equipment is mechanically coupled to the steam turbine shell to receive steam from the steam turbine shell and receives feed water through an entry port and releases feed water through an exit port. The first temperature detector is positioned to detect a first temperature of the feed water prior to entering the equipment via the entry port. The second temperature detector is positioned to detect a second temperature of the feed water after exiting the equipment via the exit port. The computer is electrically coupled to the first temperature detector and to the second temperature detector and compares the first temperature to the second temperature to generate a temperature difference. Related processes comprise detecting a first temperature of feed water immediately before the feed water has exited the heating equipment; detecting a second temperature of the feed water immediately after the feed water has entered the heating equipment; (c) comparing the first temperature to the second temperature to generate a temperature difference between the first temperature and the second temperature; (d) comparing the temperature difference with a preferred temperature difference to determine whether the temperature difference is within an approved range from the preferred temperature difference; and (e) generating a warning signal to alert the power plant operator if the temperature difference is not within the approved range.

33 Claims, 15 Drawing Sheets

POWER PLANT PERFORMANCE MANAGEMENT SYSTEMS AND METHODS

PARTIAL WAIVER OF COPYRIGHT PURSUANT TO 1077 O.G. 22(Mar. 20, 1987)

© Copyright. 1996. Basic Resources, Inc. All of the material in this patent application is subject to copyright protection under the copyright laws of the United States and of other countries. As of the first effective filing date of the present application, this material is protected as unpublished material.

However, permission to copy this material is hereby granted to the extent that the owner of the copyright rights has no objection to the facsimile reproduction by anyone of the patent document or patent disclosure, as it appears in the United States Patent and Trademark Office patent file or records, but otherwise reserves all copyright rights whatsoever.

CROSS-REFERENCE TO RELATED APPLICATIONS

The following patent application, which are filed herewith, is incorporated by reference:

| Reference Number/ Serial Number | Title | Author |
|---|---|---|
| TU-IP2003 | Process Based Performance Management Systems And Methods Used to Monitor Performance Changes in Power Plant Equipment to Operate Power Plant at High Efficiency | James N. Earley<br>Jeffrey D. Hooper<br>Billy H. Stigall<br>John S. Stinson |

FIELD OF INVENTION

The present invention generally relates to the field of equipment and processes used in power plants by plant unit operators to generally monitor and control power production. The present invention particularly relates to equipment and processes used to monitor the operation of a power plant to maintain and/or to improve the efficiency of the power plant. The present invention also particularly relates to equipment and processes used to detect potential turbine water induction incidents in order to warn power plant operators of potential turbine water induction incidents, so that they can take preventive or corrective measures.

BACKGROUND

Traditional power plants can be improved in a number of ways. Specifically, traditional power plants lack sophisticated data collection and control systems that provide real time information in a format that can be easily understood and used by power plant operators to avoid certain types of emergencies and to operate the power plant at an increased efficiency. For instance, most power plants in the world are steam powered. In these power plants, condensation (e.g., water) is typically heated in some fashion to form steam. Steam is then channeled through various steam lines and passageways (e.g., pipes) throughout a power plant to drive or turn a turbine. The turbine then drives a generator, which is used to generate electricity. Regarding early warning systems, steam, however, may condense to form a liquid condensation, which is problematic and, in some cases, catastrophic, when too much condensation is formed and resides in the wrong location. Specifically, if condensation forms in or otherwise travels to the turbine, the turbine can be completely destroyed. In fact, the potential damage of such an event is so great that the mere presence of condensation in the turbine is generally viewed in the industry as a "single point failure" and grounds to shut down the entire power plant. Of course, shutting down the power plant introduces significant, additional costs that are associated with the actual loss of power production (e.g., loss of production, replacement power expense, repairs, startup expenses).

Consequently, an early warning system that alerts power plant operators of such a condition is desperately needed in the industry. Traditional power plant designs have typically positioned condensation level detectors that detect the actual presence of condensation in the turbine shell holding a turbine, in steam lines or other passageways that transport the steam from or to a turbine shell holding a turbine, or actually in peripheral equipment joined to a turbine (e.g., heaters). These level detectors are mechanical in nature and generally involve a mechanical float of some sort with electrical connections that are activated as the mechanical float rises past a series of electrical contacts. Since these level detectors have moving parts that are mechanical in nature and are constantly exposed to and/or immersed in purified water, they often corrode and, thus, do not always work as expected when needed. In addition, these level detectors are static detectors in that they are only activated when the condensation level rises to a dangerous level. As a result, it is difficult to test these types of detectors without significantly altering the operation of the power plant (e.g., shut down the plant). Similarly, temperature detectors are sometimes positioned inside the turbine shell holding the turbine and/or in steam lines linked to the turbine to detect changes in temperature over time at various locations. Unfortunately, however, information provided by these temperature detectors is seldom used or analyzed to accurately predict the presence of condensation in the turbine in a timely manner, because, in part, the information is not generally available. And, additionally, this temperature information is not generally available to power plant operators in real time, so that the power plant operator cannot use this information on an on-going, continuous basis. Moreover, additional information which is needed to make quick decisions, is not available, much less presented to the plant operator in a format allowing a quick analysis and review. As a result, at best, these temperature detectors provide only a last minute warning signal, which is not satisfactory. The need for an early warning system is especially critical in light of the fact that condensation in a typical power plant can back up into a turbine from peripheral equipment, such as a heater, in less than a few minutes, which provides very little time to diagnose a potential failure and to take corrective action. Thus, since condensation is already in the turbine or nearly in the turbine (e.g., in the steam lines connected to the turbine shell, which holds the turbine) before these temperature detectors detect a change in the temperature and, therefore, are not capable of providing any warning whatsoever, it is absolutely imperative that improved warning systems be provided to power plant operators in the future.

In addition, the lack of an early warning system is a consequence of the fact that sufficient, ongoing, continuous information is not available or routinely presented to the power plant operator. Static detectors and traditional control systems do not provide sufficient or timely feedback to enable the power plant operator to continuously monitor the overall power production cycle in order to keep a power plant operating at its highest efficiency, thereby reducing plant fuel costs. The efficiency or plant characteristics may vary with minor variances in the fuel (e.g., one load of coal verses another load of coal), outside weather conditions, and the load across the power plant, and the like. Immediate information that is continuously provided to the power plant operator would allow the power plant operator to better manage the operation of the plant, especially if such information is presented in a format that allows the power plant operator to review and analyze crucial information in a timely manner.

SUMMARY

The disclosed invention pertains to an apparatus and to related methods and systems that are used to monitor and control the operation of a power plant. Specifically, preferred embodiments continuously monitor certain thermodynamic properties of specific pieces of equipment that may potentially generate or otherwise hold excess amounts of condensation or feed water. Feed water is the term used to describe the liquid condensation that is heated by the power plant to produce steam. As discussed above, excess amounts of feed water in the wrong location may severely damage certain pieces of equipment (e.g., the turbine) and/or affect the efficiency of the overall power plant. When the thermodynamic properties approach particular, predefined values, preferred embodiments alert the power plant operator. This signal allows the power plant operator to initiate precautionary adjustments or actions that may depend upon other circumstances to avoid potential problems, such as a turbine water induction incident (feed water in the turbine), and/or to keep the power plant operating at peak efficiency.

Preferred embodiments of the steam powered electrical power generating station provide electricity and are comprised of a steam turbine positioned in a steam turbine shell, a piece of equipment, a first temperature detector, a second temperature detector, and a computer to evaluate various sorts of information. The steam turbine has at least one blade and a shaft joined to the at least one blade. The shaft is also joined to turn an electrical generator, so that the electrical generator can create electricity. Of course, the steam turbine shell is joined to receive steam to turn the at least one blade of the steam turbine. The piece of equipment (e.g., low pressure feed water heater, high pressure feed water heater, deaerator, auxiliary coolers condenser, and pumps) is joined to the steam turbine shell to receive steam from the steam turbine shell. The piece of equipment generally receives feed water through an entry port and releases feed water through an exit port. The piece of equipment performs certain operations on the feed water, such as pre-heating the feed water before the feed water is transferred to a boiler, which will be described below. The first temperature detector is positioned near the piece of equipment to detect a first temperature of the feed water prior to entering the first piece of equipment via the entry port, which is called the first temperature. The second temperature detector is positioned to detect another temperature of the feed water after exiting the piece of equipment via the exit port, which is called the second temperature. The computer is electrically coupled to the first temperature detector and to the second temperature detector and is programmed to evaluate the first and second temperatures in relation to one another. The computer compares the first temperature to the second temperature to generate a temperature difference and compares the temperature difference with a standard temperature difference. In other preferred embodiments, the computer can also perform a variety of other operations. Specifically, the computer can determine whether the piece of equipment is operating correctly and/or whether the piece of equipment has an excess amount of condensation that is in danger of traveling into the steam turbine shell. Preferred embodiments may also be comprised of additional equipment as well. Specifically, as referenced above, preferred embodiments may also be comprised of a burner and a boiler. The burner processes fuel (e.g., gas, pulverized coal, lignite) to generate heat, which is used to heat the boiler to convert feed water into steam, which, in turn, is transported to the steam turbine shell to turn the turbine.

Preferred embodiments also use additional detection and monitoring systems as an optional, secondary or back-up to the detection and monitoring system discussed above. For instance, preferred embodiments may further comprise at least one temperature detector in the steam turbine shell that is also electrically coupled to the computer, which is activated when condensation reaches the steam turbine shell. The computer continuously monitors the temperature detector(s) and triggers a warning signal to a plant operator operating the steam powered electrical power generating station when the temperature detector is activated. Differences in temperature detected by various temperature detectors in the turbine shell indicate or imply the presence of condensate in the turbine shell. In addition, preferred embodiments are also comprised of a level detector in the piece of equipment. This level detector is also electrically coupled to the computer and is activated when condensation in the piece of equipment reaches a certain, predefined level. Once again, the computer continuously monitors this level detector and triggers a warning signal to a plant operator when this level detector is activated. Also, additional temperature detectors can be positioned in mechanical passageway(s) that connect the steam turbine or the steam turbine shell to the first piece of equipment. These additional temperature detectors are also electrically coupled to the computer and compare the temperature detected by these temperature detectors to a standard temperature. The standard temperature may be associated with a normal operating condition or with an alarm condition. The computer may also compare temperature readings of a particular temperature detector over time to monitor the operation of the power plant. Either way, the computer continuously monitors the temperature and, if necessary, triggers a warning signal to the power plant operator.

Preferred methods are generally comprised of detecting a first temperature of feed water immediately before the feed water has entered heating equipment; detecting a second temperature of the feed water immediately after the feed water has exited the heating equipment; comparing the first temperature to the second temperature to generate a temperature difference between the first temperature and the second temperature; comparing the temperature difference with a preferred temperature difference to determine whether the temperature difference is within the approved range from the preferred temperature difference; and generating a warning signal to alert the power plant operator if the temperature difference is not within the approved range. Preferred processes may also be comprised of detecting a condensation level within the heating equipment; comparing the condensation level with a preferred condensation level to determine whether the condensation level exceeds the preferred condensation level; and generating a warning signal to alert the power plant operator if the condensation level exceeds the preferred condensation level. Similarly, preferred processes may also be comprised of detecting a third temperature of the steam in the mechanical passageway; and comparing the third temperature to a standard temperature to determine if steam is being transported via the mechanical passageway or whether condensation is present in the mechanical passageway. The first temperature is periodically detected at a first interval and the second temperature is periodically detected at a second interval. The first and second interval is preferably equal to two seconds. Note, as with the preferred system, once the preferred embodiment compares the measured readings, computes the temperature difference, and then compares the difference to a standard temperature difference, the warning signal generated can inform the plant operator that immediate, corrective action is needed to avoid imminent danger and/or that minor adjustments are needed to keep the power plant operating at peak efficiency.

Preferred embodiments provide a number of advantages. In particular, preferred embodiments continuously and periodically check the temperature measurements before and after the piece of equipment. Generally, preferred embodiments check the temperature at a preset interval (e.g., two (2) seconds). The interval that one temperature detector is checked may vary from the interval that a second temperature detector is checked. Temperature detectors and level detectors located elsewhere are preferably continuously (and periodically) checked as well. Preferred embodiments evaluate the heat rate of steam and condensation at various locations in the overall power plant. Additionally, preferred embodiments help diagnose problems at various locations in the overall power plant, such as in the low pressure and high pressure heaters. Preferred embodiments also provide an early warning of potential turbine water induction incidents, so that such incidents can be prevented. Moreover, preferred embodiments are reliable and accurate. Finally, preferred embodiments allow the power plant operator to control the overall power plant operations, specifically the feed water heater's performance, so that the overall power plant operation is at its highest efficiency, which significantly reduces the fuel costs of the power plant.

Other advantages of the invention and/or inventions described herein will be explained in greater detail below.

BRIEF DESCRIPTION OF THE DRAWINGS

The accompanying drawings are incorporated into and form a part of the specification to illustrate several examples of the present inventions. These drawings together with the description serve to explain the principles of the inventions. The drawings are only for the purpose of illustrating preferred and alternative examples of how the inventions can be made and used and are not to be construed as limiting the inventions to only the illustrated and described examples. Further features and advantages will become apparent from the following and more particular description of the various embodiments of the invention, as illustrated in the accompanying drawings, wherein.

DETAILED DESCRIPTION OF THE PREFERRED EMBODIMENT

Figure 1:
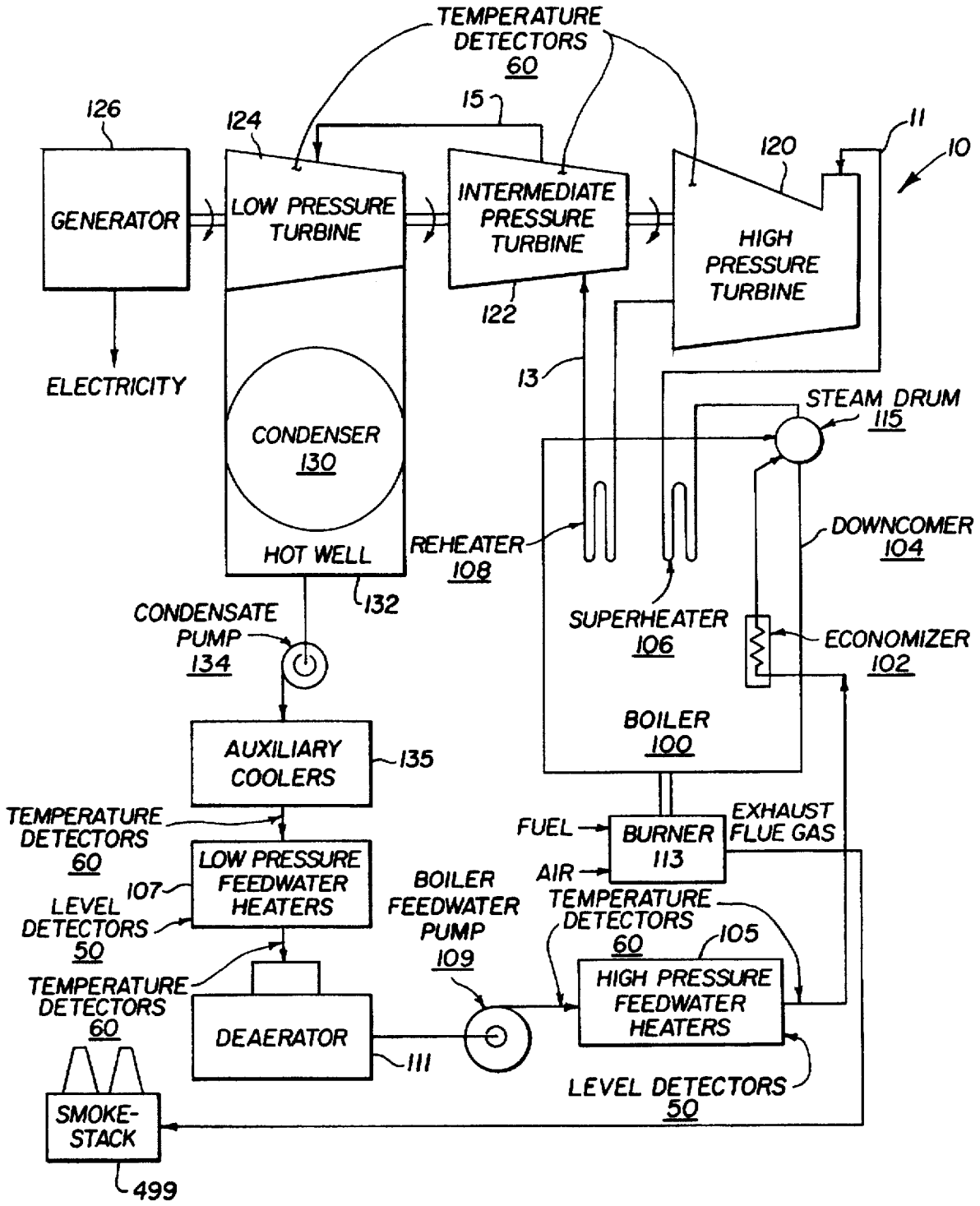
FIG. 1 illustrates a general schematic system diagram of a steam-powered electric generating station 10, which, among other things, shows the general relationship of the main components of a preferred steam-powered electric generating station 10.

The preferred embodiment will be described by referring to apparatus and methods showing various examples of how the inventions can be made and used. When possible, like reference characters are used throughout the several views of the drawing to indicate like or corresponding parts.

Referring to FIG. 1, fuel (e.g., pulverized coal, gas, or lignite coal) and air are channeled into burner 113 to heat feed water in boiler 100 to a sufficient temperature to produce steam. Exhaust flue gas is directly or indirectly channeled to smoke stack 499. Although not shown in FIGS. 1 and 2, scrubbers and additional equipment may be used in preferred embodiments as well. Boiler feed water pump 109 supplies boiler 100 with slightly more than 4,000,000 pounds of pressured feed water per hour at a pressure of about 4300 psia. Economizer 102 preheats the feed water before the feed water is heated by the water walls of boiler 100. The steam is generally heated further with superheater 106 to produce "live" or "superheated" steam (hereafter "superheated steam"). The superheated steam is then passed through one or more turbines, such as high pressure turbine 120, intermediate pressure turbine 122, and low pressure turbine 124 (and/or other energy extraction mechanisms) to convert the energy present in the superheated steam into mechanical energy. The turbines drive electrical generator 126 to generate electricity, thereby converting the mechanical energy into electrical energy.

Specifically, superheated steam is typically passed through a number of turbine stages that are preferably positioned in series with one another, in order to extract as much energy as possible from the superheated steam. For instance, superheated steam at first heat and pressure point 11 (e.g., 1000° F. at 3675 psia), which is generally the highest heat and pressure point, will be used to drive high-pressure turbine 120. The exhaust from the high-pressure turbine 120 is superheated steam at the second heat and pressure point 13 (e.g., 1000° F. at 700 psia) and is generally at a lower heat and pressure than at first pressure point 11. The superheated steam at second heat and pressure point 13 drives intermediate pressure turbine 122. Note that reheater 108 may be used to boost the temperature of superheated steam at the second pressure point 13. Superheated steam at third heat and pressure point 15 (e.g., 160°–165° F. at 175 psia.) is at a lower temperature and pressure point than that of first and second heat and pressure points 11 and 13. The superheated steam at third heat and pressure point 15 drives low pressure turbine 124. The exhaust steam from the low-pressure turbine 124 varies with the load and is fed directly into condenser 130. Note low-pressure turbine 124, in the presently preferred embodiment, sits directly on top of condenser 130. The pressure at the exhaust of low pressure turbine 124 is slightly negative or less than the atmospheric pressure, due to the volumetric change which occurs in condenser 130. At hot well 132, the temperature will be no more than 140° F. (and typically about 125° F.) and the absolute pressure will be about 3 inches of Hg. Please note that this is a vacuum of about 13 psi relative to the atmosphere. Condensation created by condenser 130 is then pumped through auxiliary coolers 135 by condensate pump 134 and then into low-pressure feed water heaters 107 and deaerator 111. Feed water pump 109 pumps condensation from deaerator 111 through high pressure feed water heaters 105. Bottoming cycles, which extract the last economical bit of thermal energy from the superheated steam, and heat exchangers, which scavenge heat from the depleted steam for feed water heating, process heat and may also be used. For instance, although not shown, downcomer and waterwall tubes help scavenge heat generated by burner 113.

Figure 2:
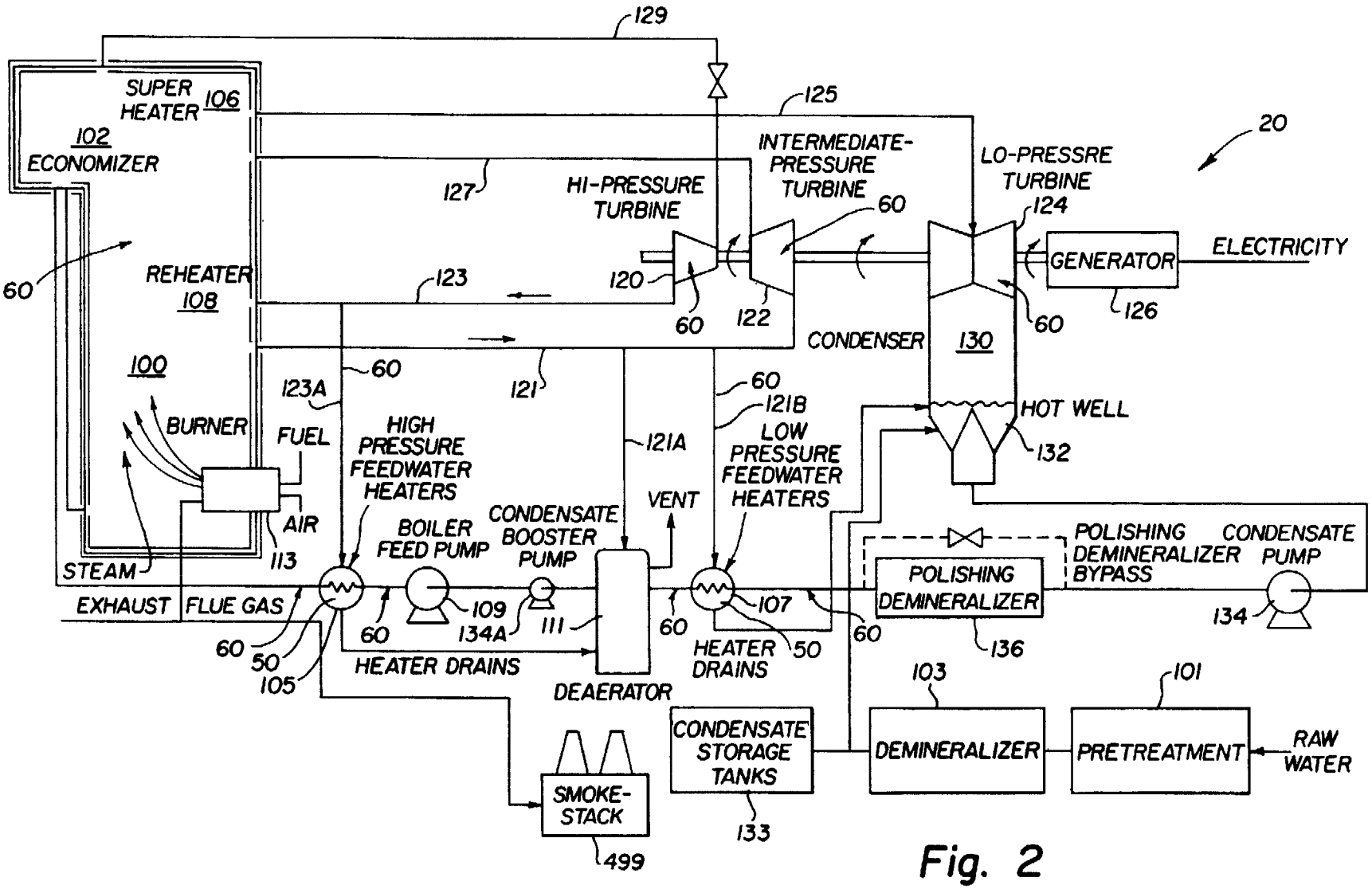
FIG. 2 illustrates a more detailed schematic view of steam-powered electric generating station 20, which, among other things, shows the use of steam from high pressure turbine 120 and intermediate pressure turbine 122 to enable high pressure feed water heaters 105 and low pressure feed water heaters 107 to heat feed water via steam lines 121 and 123.

Referring to FIG. 2, in addition to the components and relationships discussed above, please note the additional detail showing steam lines 121, 123, 125, 127, and 129, which are used to transport steam to and from high pressure turbine 120, intermediate pressure turbine 122, and low pressure turbine 124. Steam is extracted from steam line 121 via steam line 121A to deaerator 111 and from steam line 121B to heat low pressure feed water heaters 107. Steam is also extracted from steam line 123 via steam line 123A to heat high pressure feed water heaters 105. Note that feed water is preferably heated by at least one feed water heater, such as low pressure feed water heaters 107 and high pressure feed water heaters 105, to a temperature as great as economically feasible. In addition, note, while most of feed water for boiler 100 is recycled condensation, which is stored in the hot well 132, condensation may be supplemented by raw water, that is processed through pretreatment 101 and demineralizer 103 and stored for use in condensation storage tank 133. Likewise, polishing demineralizer 136, along with a corresponding polishing demineralizer bypass, may also be used to demineralize condensation received from condensation pump 134.

Figure 3:
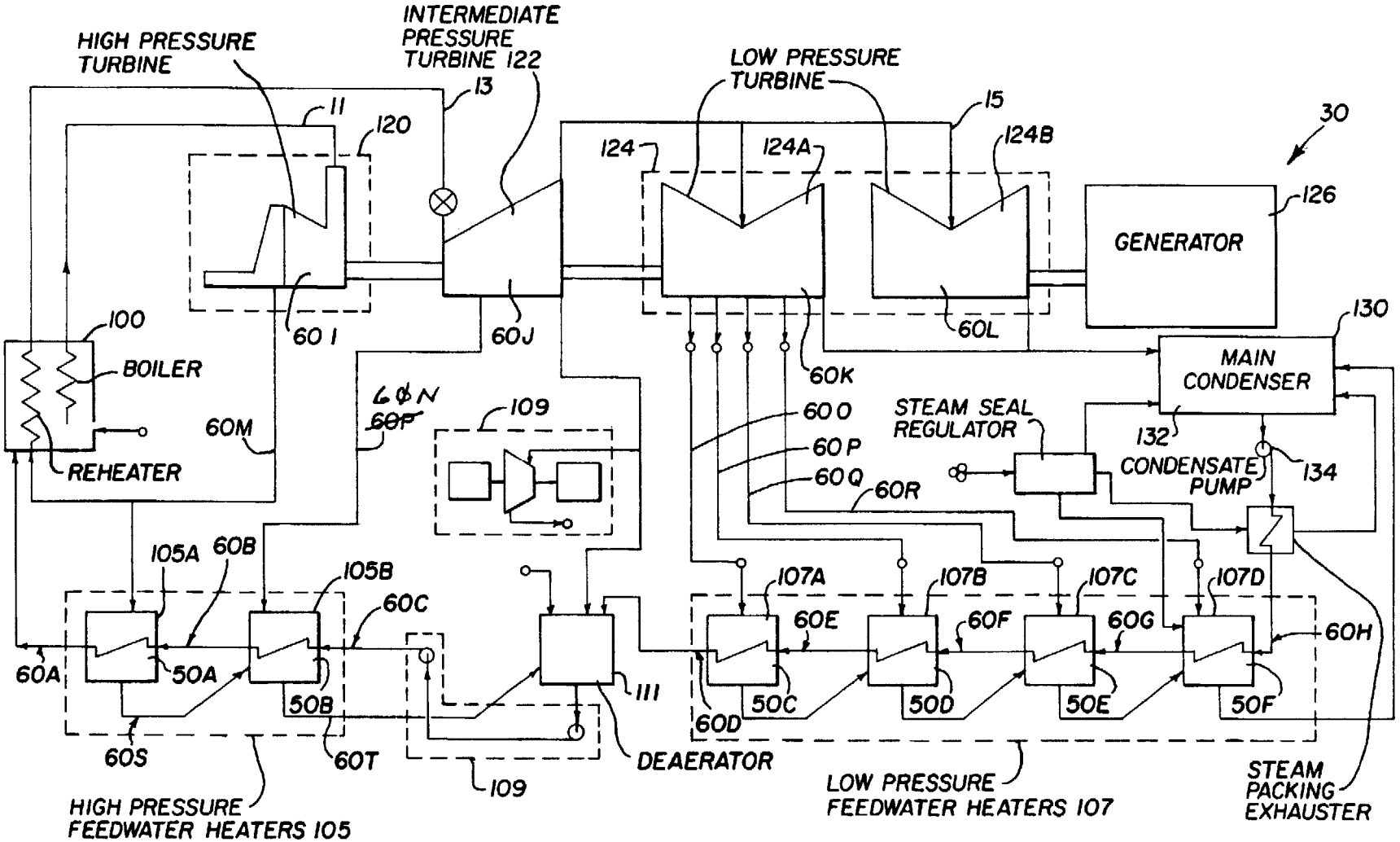
FIG. 3 illustrates a detailed schematic view of steam-powered electric generating station 30, which, among other things, shows the specific equipment interconnections in a preferred embodiment, and the actual number of high pressure heaters 105A and 105B used to form high pressure heaters 105 (in FIGS. 1 and 2) and the actual number of low pressure heaters 107A, 107B, 107C, and 107D used to form low pressure heaters 107 (in FIGS. 1 and 2)

FIG. 3 illustrates a detailed schematic view of steam-powered electric generating station 30, which, among other things, shows the specific equipment interconnections in a preferred embodiment. Note the actual number of high pressure feed water heaters 105A and 105B used to form high pressure feed water heaters 105 (in FIGS. 1 and 2) and the actual number of low pressure feed water heaters 107A, 107B, 107C, and 107D used to form low pressure feed water heaters 107 (in FIGS. 1 and 2) and the interconnections of the steam lines between these heaters.

A number of sensors are positioned throughout the plant at various locations to provide immediate and continuous sources of information to warn the power plant operator of potential problems and to generally monitor the operation of the power plant for efficiency purposes. For instance, referring to FIGS. 1 and 2, temperature detectors 60 are preferably positioned at various locations throughout a power plant. Specifically, as shown in FIG. 3, temperature detectors 60 are preferably positioned before and after low pressure feed water heaters 107 and before and after high pressure feed water heaters 105, as well as between high pressure feed water heaters 105A and 105B and between low pressure feed water heaters 107A, 107B, 107C and 107D. Likewise, as shown in FIGS. 1, 2, and 3, temperature detectors 60 may actually be positioned inside low pressure turbine 124, intermediate pressure turbine 122, and high pressure turbine 120. Also, as shown in FIGS. 2 and 3, temperature detectors may also be positioned in the passageways transferring steam extracted from the turbine to specific equipment, such as steam lines 123A and 121B. Similarly, level detectors 50 that detect the level of condensation are preferably placed in low pressure feed water heaters 107 and high pressure feed water heaters 105 to detect the level of condensation inside low pressure feed water heaters 107 and high pressure feed water heaters 105. Note level detectors 50 are actually labeled 50A, 50B, 50C, 50D, 50E, and 50F in FIG. 3 and temperature detectors 60 are actually labeled 60A, 60B, 60C, 60D, 60E, 60F, 60G, 60H, 60I, 60J, 60K, 60L, 60M, 60N, 60O, 60P, 60Q, and 60R in FIG. 3. Also, level detectors 50 and temperature detectors 60 are indicated by their location in FIGS. 1, 2, and 3, as opposed to a graphical symbol.

Figure 4:
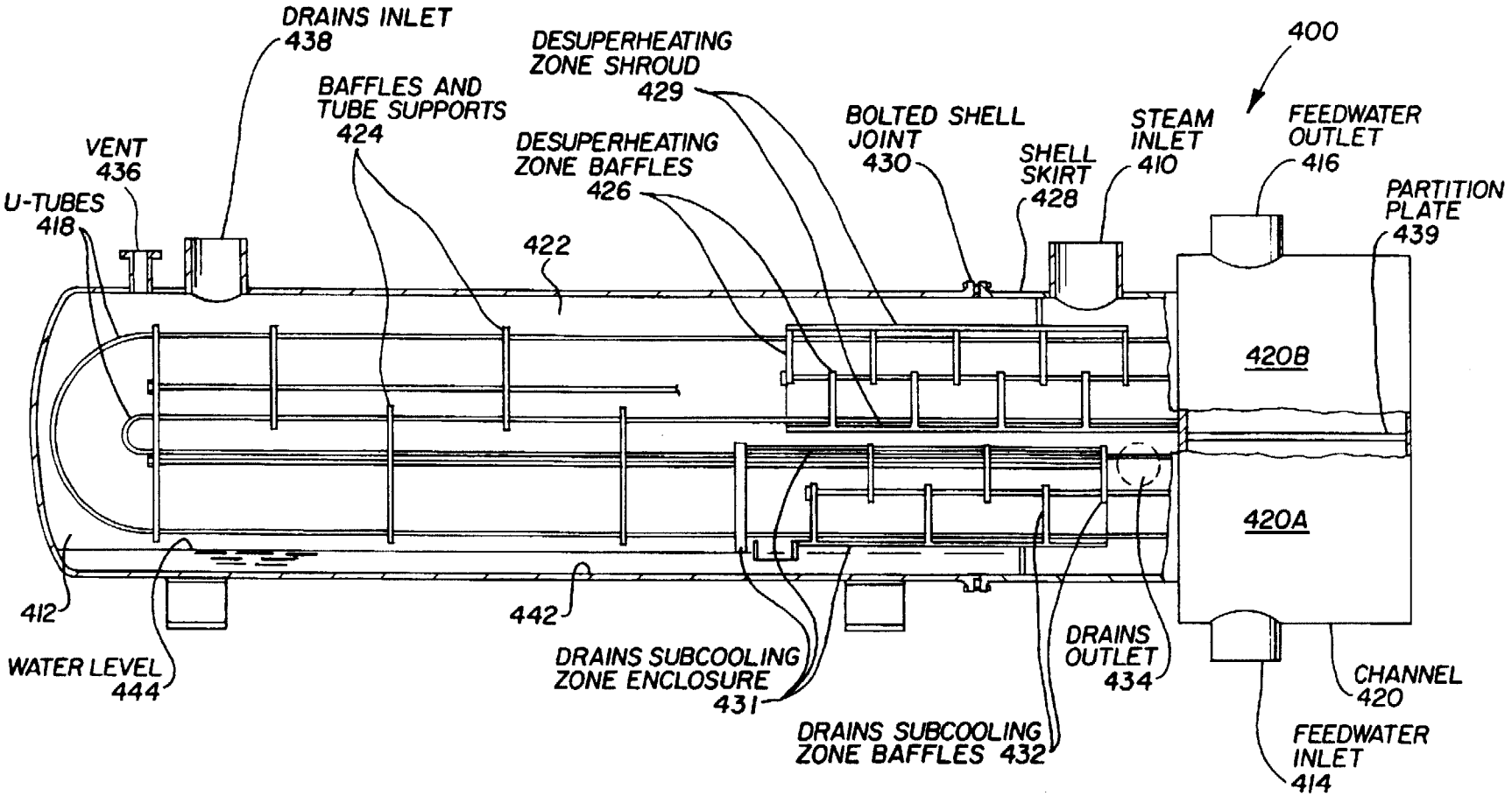
FIG. 4 illustrates a cross-sectional view of a typical preferred three-zone feed water heater, such as high pressure heater 105A or 105B (in FIG. 3) or low pressure heaters 107A, 107B, 107C, and 107D (in FIG. 3)

FIG. 4 illustrates a cross-sectional view of a typical three-zone feed water heater 400, such as high pressure heater 105A or 105B (in FIG. 3) or low pressure heater 107A, 107B, 107C, and 107D (in FIG. 3), which is used in preferred embodiments. A feed water heater's primary function is to capture latent heat from the steam extracted from a turbine, such as high pressure turbine 120, intermediate pressure turbine 122, and low pressure turbine 124, before the steam enters condenser 130, where the heat energy would be dissipated in a heat sink, such as an outdoor lake, cooling tower, etc. Steam extracted from the turbine is inputted into the feed water heater 400 via steam inlet 410, which fills voids 412 inside feed water heater 400. Vent 436 provides selective access to voids 412. Heater 400 is preferably surrounded with a shell skirt 428. A bolted shell joint 430 is optional. Feed water is directed into feed water heater 400 via feed water inlet 414 and through U-tubes 418 and eventually out feed water outlet 416. Heater 400 is designed to increase the temperature of the feed water entering heater 400 a specified, definite amount for a given turbine loading and feed water flow. Note channel 420 is preferably divided into two partitions 420A and 420B by partition plate 439, so that the incoming feed water is not directly mixed with the outgoing feed water.

In addition, while FIG. 4 symbolically represents U-tubes 418 as two (2) actual tubes that extend out into inner chamber 422, please note that U-tubes 418 are in fact an intricate array or bundle of tubes that hold feed water. U-tubes 418 form a condensing zone in which most of the steam is condensed and most of the heat transfer takes place. Baffles and tube supports 424 are used to support U-tubes 418 and to provide control fluid flow across the outside surfaces of all tubes in the condensing zone. Desuperheating zone baffles 426 and desuperheating zone shroud 429 combine to provide a separator counterflow heat exchanger that is contained within the heater sheet. The purpose of the desuperheating zone is to remove superheat from the steam. Drains subcooling zone enclosure 430, drains subcooling zone baffles 432, and drains outlet 434 combine to form another counterflow, the purpose of which is to subcool incoming drains. As a general rule, most subcooling zones are employed to reduce the saturation temperature of the condensate in the shell of the drain outlet to approach 10° F. above the feed water inlet temperature. Desuperheating zones and subcooling zones generally involve sensible heat transfer, in which both the temperature and the pressure of the fluid flowing on the shell side are reduced. Consequently, condensation is released, which forms inside the inner chamber 422, as the steam transports heat to the feed water in U-tubes 418 and cools and condenses into liquid form.

Condensation generally flows to the bottom surface of inner chamber 422 and rises to condensation level 444. In addition, although not desired, U-tubes 418 sometimes develop a leak and leak feed water into the inner chamber 422 as well. Of course, condensation level 444 is variable and, if it is too high, it is problematic, as condensation can flow out of steam inlet 410 into one or more turbines (e.g., high-pressure turbine 120, intermediate pressure turbine 122, and low-pressure turbine 124 in FIGS. 1, 2, and 3). When combined with drain inlet 438, drain subcooling zone enclosure 431, drain subcooling zone baffles 432, and drain outlet 434 enable the power plant operator to control the internal temperature in inner chamber 422 and thereby control the actual heating of the feed water in U-tubes 418, since the degree of water affects the overall temperature in the inner chamber 422, which provides the heat to heat U-tubes 418, and, if in contact with U-tubes 418, affects the transfer of heat to feed water in U-tubes 418.

A feed water heater is preferably designed to increase the temperature of the feed water a definite amount for a given turbine loading and feed water flow. Note that in certain types of boilers, such as in a "once through" boiler, turbine loading and feed water flow are proportional. The temperature of the feed water and changes in the temperature of the feed water are affected by any one of a number of factors by itself or in combination with one or more other factors. Significant factors include (i) changes in the steam flow to heater 400 through steam inlet 410; (ii) changes in feed water flow to heater 400 through feed water inlet 414; (iii) changes in the condensing surface area around inner chamber 422 of heater 400; (iv) changes in the temperature of the incoming feed water entering heater 400 via feed water inlet 414; (v) changes in the temperature of the steam entering heater 400 via steam inlet 410; and/or (vi) mechanical failure of heater 400 (e.g., U-tubes 418 develop a leak or inner chamber 422 is punctured).

Specifically, regarding the first factor, a change in steam flow to heater 400 can be attributed to a mechanical restriction in steam line(s) 123 and/or 121 (in FIG. 2), a temperature change of the feed water, or a load change. A mechanical restriction in steam line(s) 121 and/or 123 (in FIG. 2) may be simply a closed valve or line blockage. Temperature changes of feed water may be due to the fact that cooler feed water will draw more extraction steam into heater 400 and warmer feed water will restrict extraction steam to heater 400. Load changes affect the turbine steam requirements, which, in turn, affects the amount of steam that is available to be extracted.

Regarding the second factor, a change in feed water flow to heater 400 can be attributed to mechanical restriction of the feed water supply line and/or load reduction. A change in the condensing surface around U-tubes 418 of heater 400 can be attributed to a change in the heater water level. A high water level in heater 400 corresponds to additional U-tubes 418 being submerged in water. As more U-tubes 418 are covered by condensation, fewer U-tubes 418 can be utilized to condense extraction steam. A high condensation level can be caused from leaking U-tubes 418 in heater 400 and/or a stuck, blocked, or malfunctioning drain valve in drain subcooling zone baffles 432, drain subcooling zone enclosure 430, or drain outlet 434. A low water level in heater 400 does not correspond to fewer U-tubes 418 being submerged in condensation, but a lower water level in heater 400 will reduce the performance of heater 400.

Regarding the third factor, a change in the condensing surface area around inner chamber 422 of heater 400 may be attributed to the fact that over time portions of U-tubes 418 may be cut off or disconnected from the rest of the bundle of U-tubes 418, as leaks develop, etc. It is generally cheaper to merely seal off one tube from the bundle, than to remove the leaking U-tube 418. As more and more U-tubes are sealed off, the operational characteristics of the feed water heater 400 will vary.

Figure 10A:
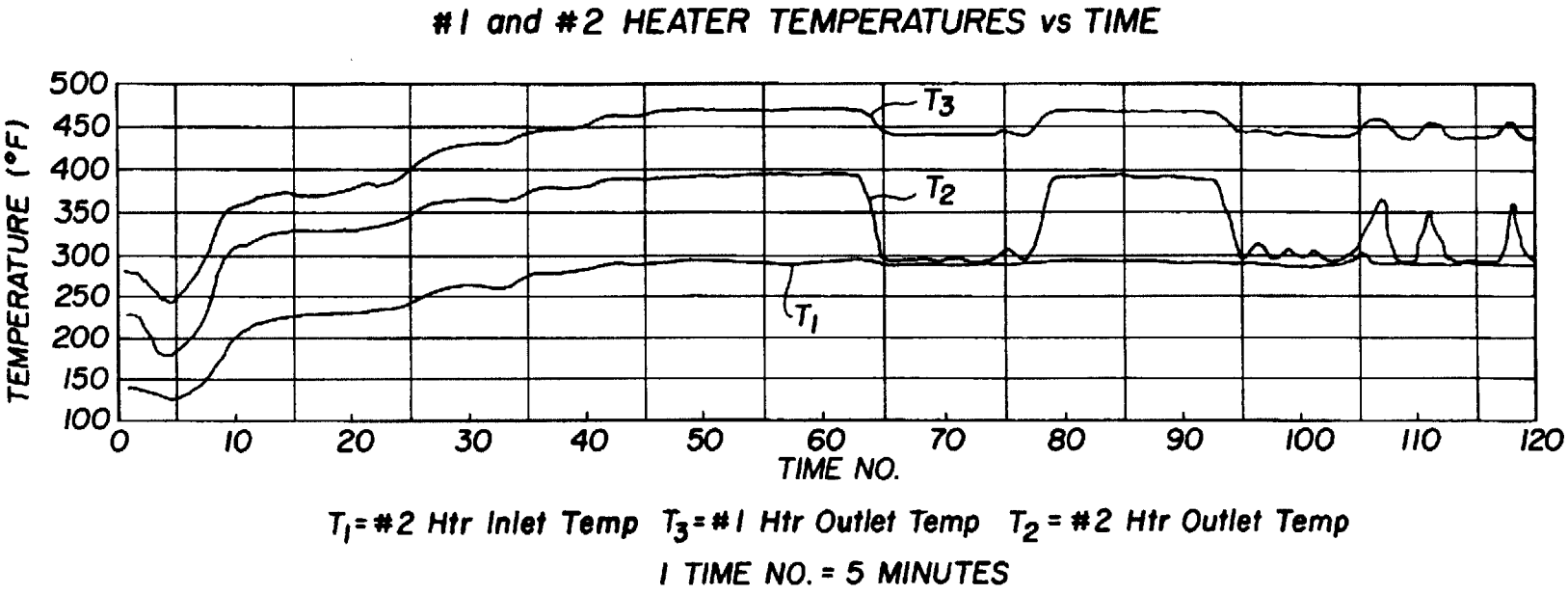
FIGS. 10A and 10B are graphs of actual data from two (2) heaters that comprise high pressure feed water heaters 105, such as high pressure feed water heaters 105A and 105B in FIG. 3, during a turbine water induction incident, showing the difference in temperature of feed water across high pressure feed water heaters 105A and 105B.
Figure 10B:
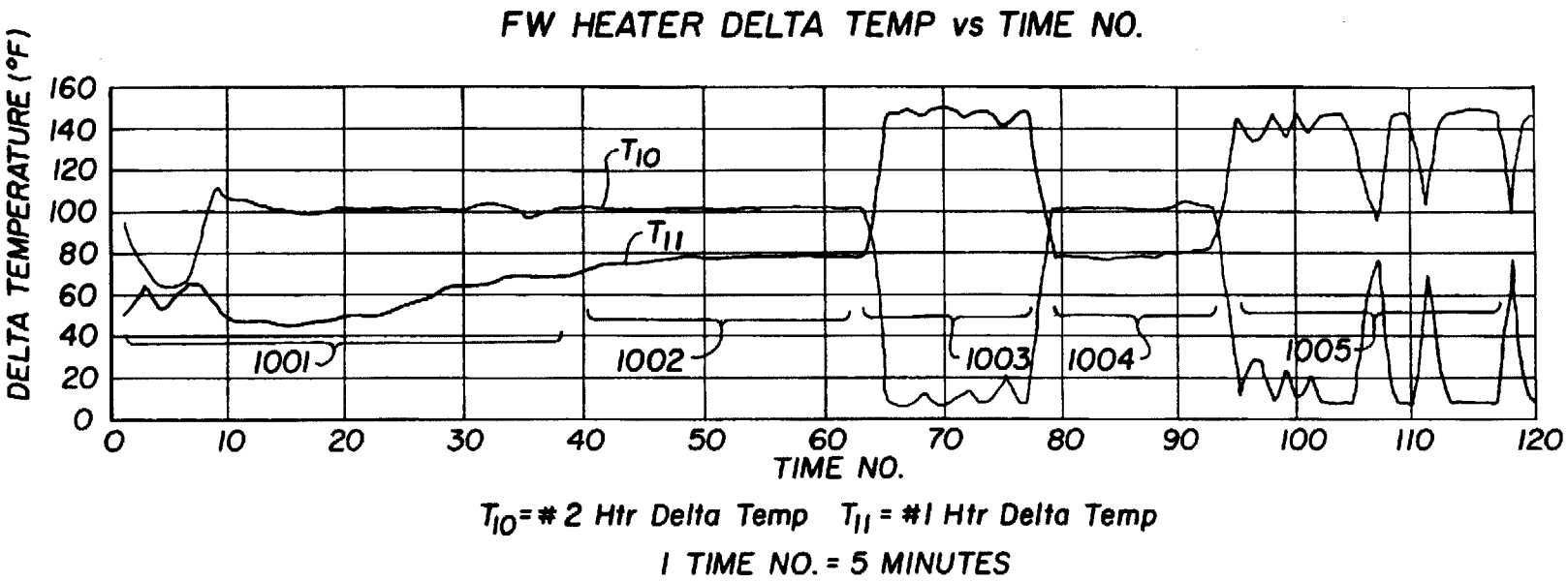

Regarding the fourth factor, a change in the inlet temperature of feed water entering feed water inlet 414 can be attributed to a problem with an upstream heater (e.g., the feed water heater prior in the feed water cycle), except for the first feed water heater in the cycle or in the series of feed water heaters. Referring to FIG. 3, feed water flow is from right to left through the various heaters. For example, low pressure feed water heater 107D is upstream from low pressure feed water heater 107C and vice versa (feed water heater 107C is down stream from low pressure feed water heater 107D). As a general rule, the temperature of feed water in condenser 130 or hot well 132 will not have a significant effect on any of the other heaters in the cycle, except for the first heater (low pressure feed water heater 107D) in the cycle. When the performance of heater 400 changes for any reason, however, the temperature of feed water at the feed water outlet 416 will change as well. And, since the temperature of feed water at the feed water outlet 416 of one heater 400 is the temperature of the feed water at the feed water inlet 414 of the next heater when the two heaters 400 are in series with one another, the next heater's performance will be affected, as the temperature of the feed water at its feed water inlet 414 is changed. FIGS. 10A and 10B, which will be discussed below, are graphs of actual data from two (2) heaters that comprise high pressure feed water heaters 105, such as high pressure feed water heaters 105A and 105B, in FIG. 3, during a turbine water induction incident showing the delta temperature of high pressure feed water.

Regarding the fifth factor, a change in the temperature of the steam extracted from the turbine that enters heater 400 via steam inlet 410 can be attributed to a problem with boiler 100 (in FIGS. 1 and 2) or one of the turbines (e.g., high pressure turbine 120, intermediate pressure turbine 122, or low pressure turbine 124). As a result, preferred embodiments should be designed to detect a problem with the steam temperature with instrumentation monitoring one or all of the turbines 120, 122, and 124 and/or boiler 100, before the problem affects the performance of heater 400, but, if detectors monitoring turbines 120, 122, and 124 or boiler 100 fail, monitoring heater 400 may alert the plant operator of a potential problem in turbines 120, 122, and 125 or in boiler 100.

Regarding the sixth factor, a mechanical failure of heater 400 can be attributed to a leak in U-tubes 418 or in the partition plate 439. Failure in the partition plate will result in lower than design temperature rise of the feed water temperature, reduced drain flow of the condensed extraction steam, and a greater than design temperature rise of the downstream heater (the next sequential feed water heater in the feed water cycle). Failures in U-tubes 418 will result in a lower rise of temperature across heater 400 than that intended when heater 400 was designed, increased drain flow of the condensed extraction steam and leaking feed water, and a greater than design temperature rise of the downstream heater (which will be discussed below in reference to FIGS. 10A and 10B). As discussed above, the performance of heater 400 will deteriorate to a less than the original installed design condition as failed U-tubes 418 are repaired by plugging them. This plugging procedure will reduce the total heat exchange surface area of heater 400, but performance degradation is fixed and can be measured to establish a new 'off design' norm.

Figure 12:
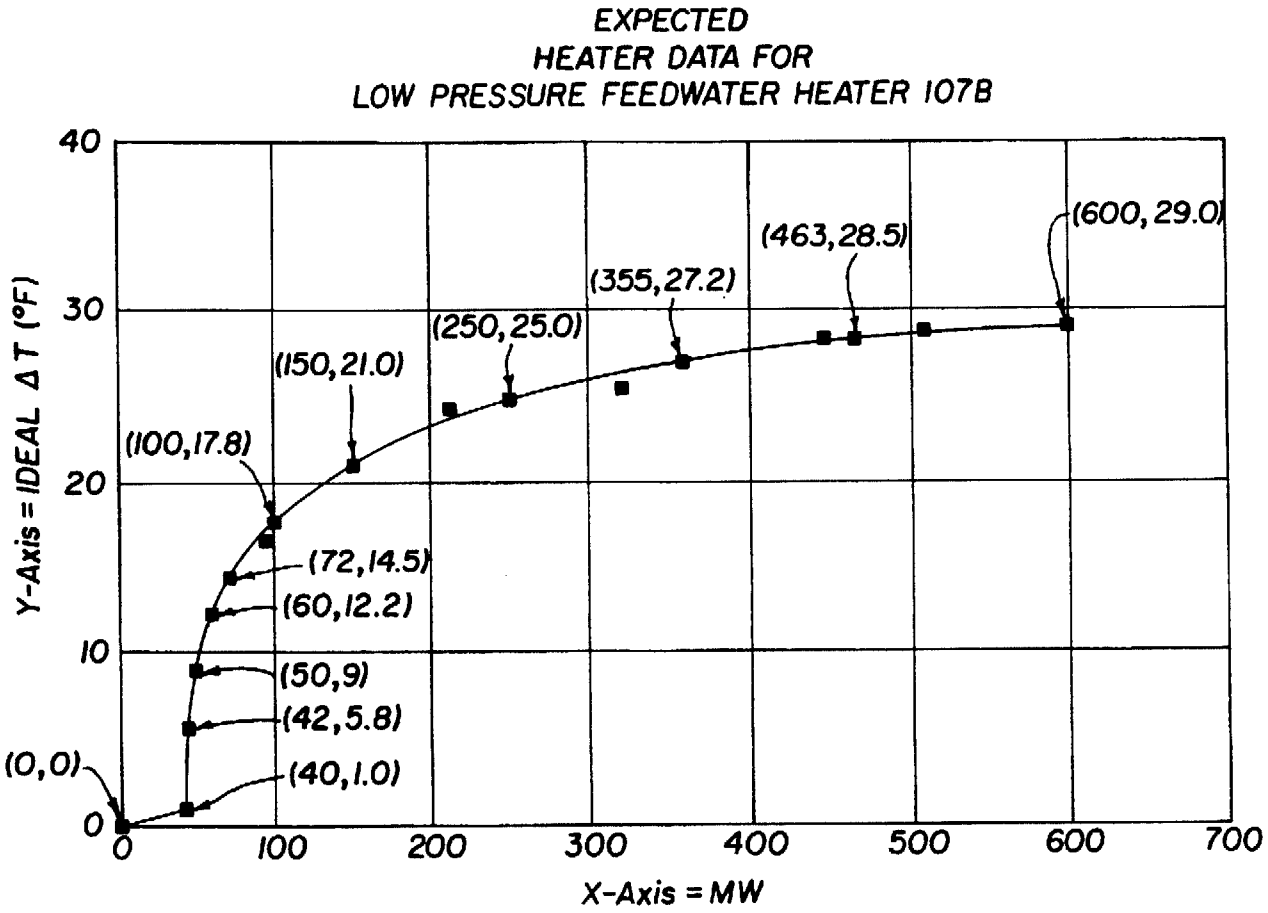
FIG. 12 is a graph of expected temperature measurements corresponding to low pressure feed water heater 107B in the power plant shown in FIG. 3 showing the relationship between the electrical load (MW) and the difference (A) in the temperature across low pressure feed water heater 107B, which is preferably used to determine the appropriate limits as well as the standard difference in temperature across low pressure feed water heater 107B.

Preferred embodiments monitor the effects of all of these factors by monitoring the temperature difference of the feed water across heater 400. With plant design information (plant design heat balance calculations) and/or unit historical data, the expected temperature rise across each heater 400 can be ascertained. With feed water flow, unit load, actual temperature rise for each heater 400, extraction steam pressures, extraction steam condensation temperatures, and heater performance can be calculated and audited against expected performance. For instance, FIG. 12 is a graph of expected temperature measurements corresponding to low pressure feed water heater 107B in the power plant shown in FIG. 3 showing the relationship between the electrical load (MW) and the difference (A) in the temperature across low pressure feed water heater 107B. This graph is used to model the performance of the low pressure feed water heater 107B in order to accurately define the standard difference in temperature for low pressure feed water heater 107B and to set the limits that will be discussed below. When the preferred embodiment detects a variation of a predetermined magnitude between actual and expected performance, the unit operator is alarmed by a plant data acquisition system, so that the power plant operator will respond by auditing the feed water heater process against design to determine the necessary action to remedy the situation.

Figure 5A:
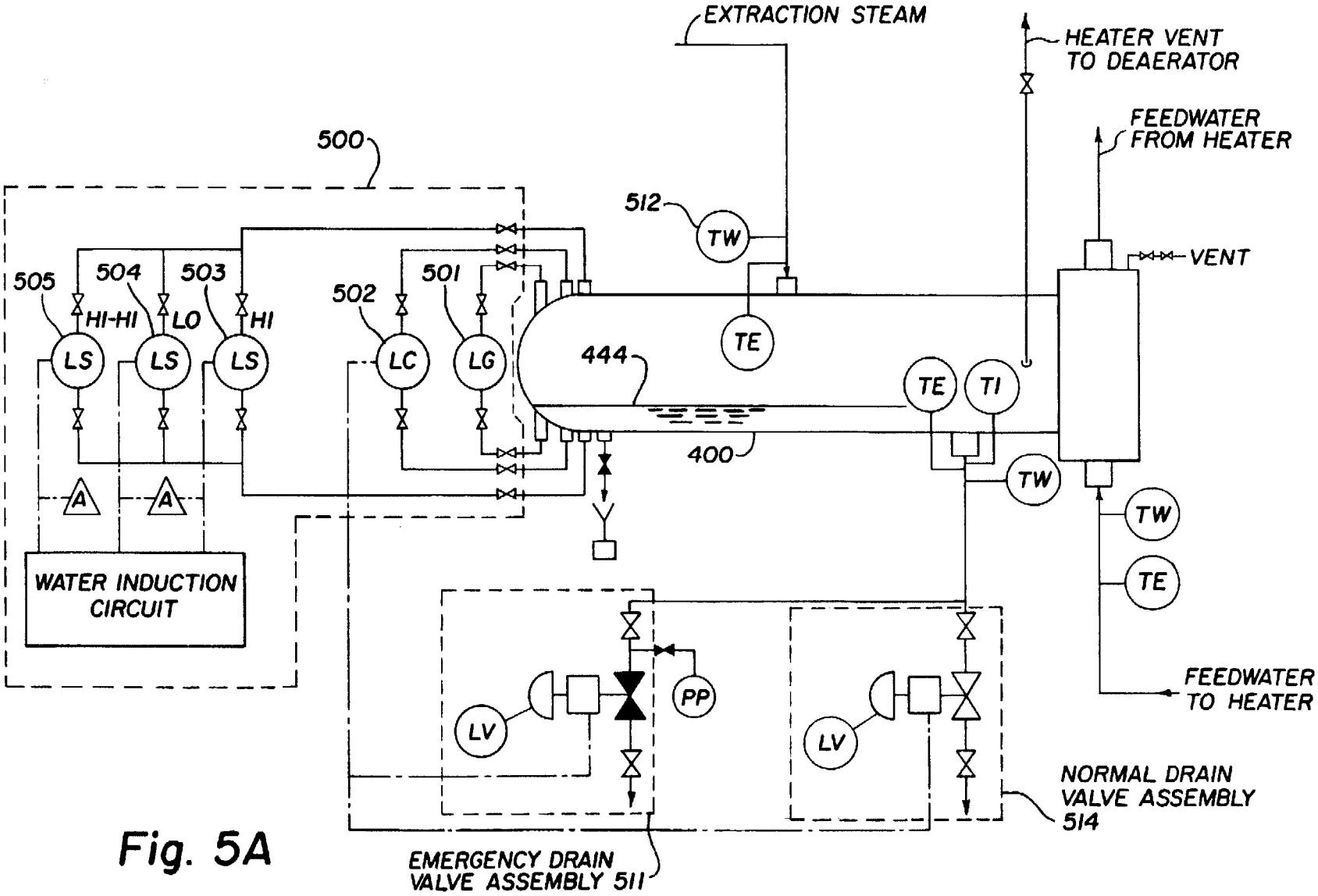
FIG. 5A illustrates a cross-sectional view of a typical bridle 500, which is comprised of various level detectors 501, 502, 503, 504, and 505 which are used to directly or indirectly monitor the water level 444 in heater 400.
Figure 5B:
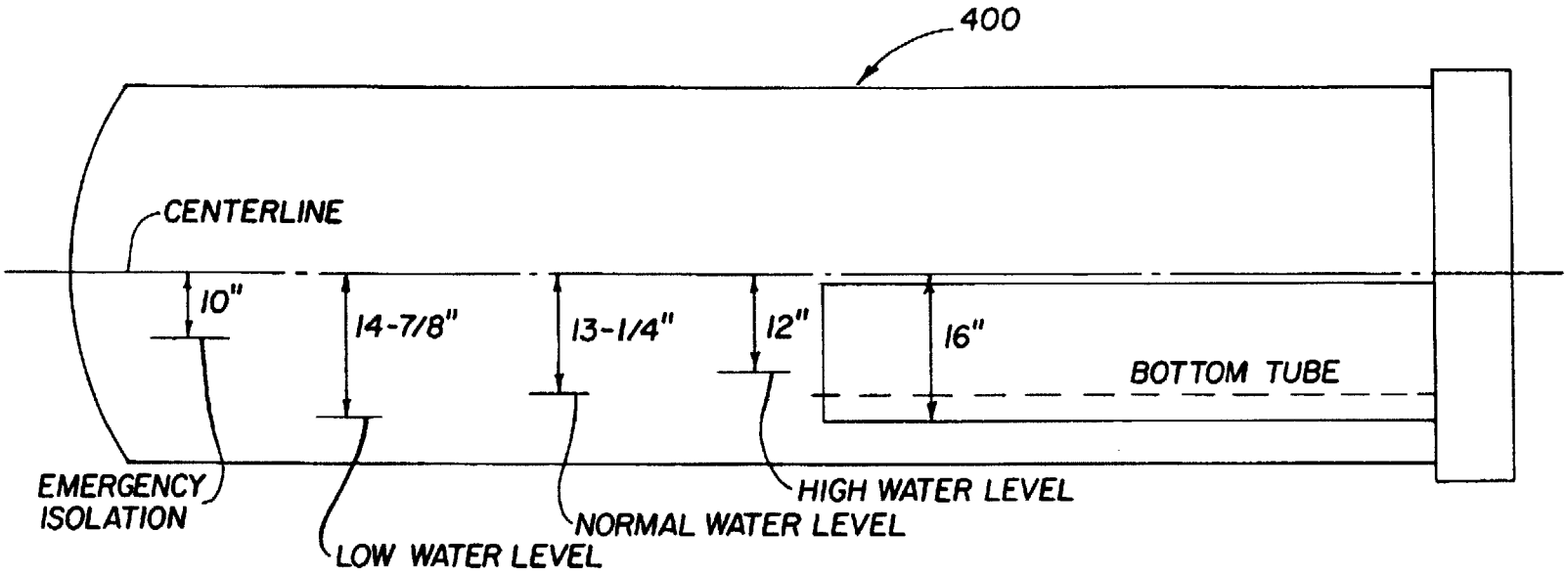
FIG. 5B shows a chart of the levels detected or monitored by level detectors 501, 502, 503, 504, and 505 (in FIG. 5A)

FIG. 5A illustrates a typical process instructional diagram of a feed water heater, illustrating a cross-sectional view of bundle 500, which is comprised of various level detectors 50 (in FIGS. 1 and 2) which are used to directly or indirectly monitor the water level 444 in heater 400. In particular, level detectors 501, 502, 503, 504, and 505 monitor the position of water level 444. Also, note emergency drain value assembly 511 and the normal drain valve 514. Note "TW" stands for thermal well; "TE" stands for thermal element; "TI" stands for temperature indicator; "LV" stands for level valve; "LS" stands for level switch; "LC" stands for level controller; "LG" stands for level glass; and "PP" stands for pressure port. FIG. 5B shows the levels detected or monitored by level detectors 501, 502, 503, 504, and 505. In a preferred embodiment, these levels are generally defined by the following Table 1:

TABLE 1

FEED WATER HEATER WATER LEVEL LIMITS

| Water Levels | Inches below Shell Centerline | Comments |
|---|---|---|
| Normal Water Level | 13¼ | 3½ Tube Rows Submerged |
| Low Water Level | 14⅞ | 1½ Tube Rows Submerged |
| High Water Level | 12 | 5 Tube Rows Submerged |
| Emergency Isolation | 10 | 5 Tubes Rows Submerged |

Figure 6:
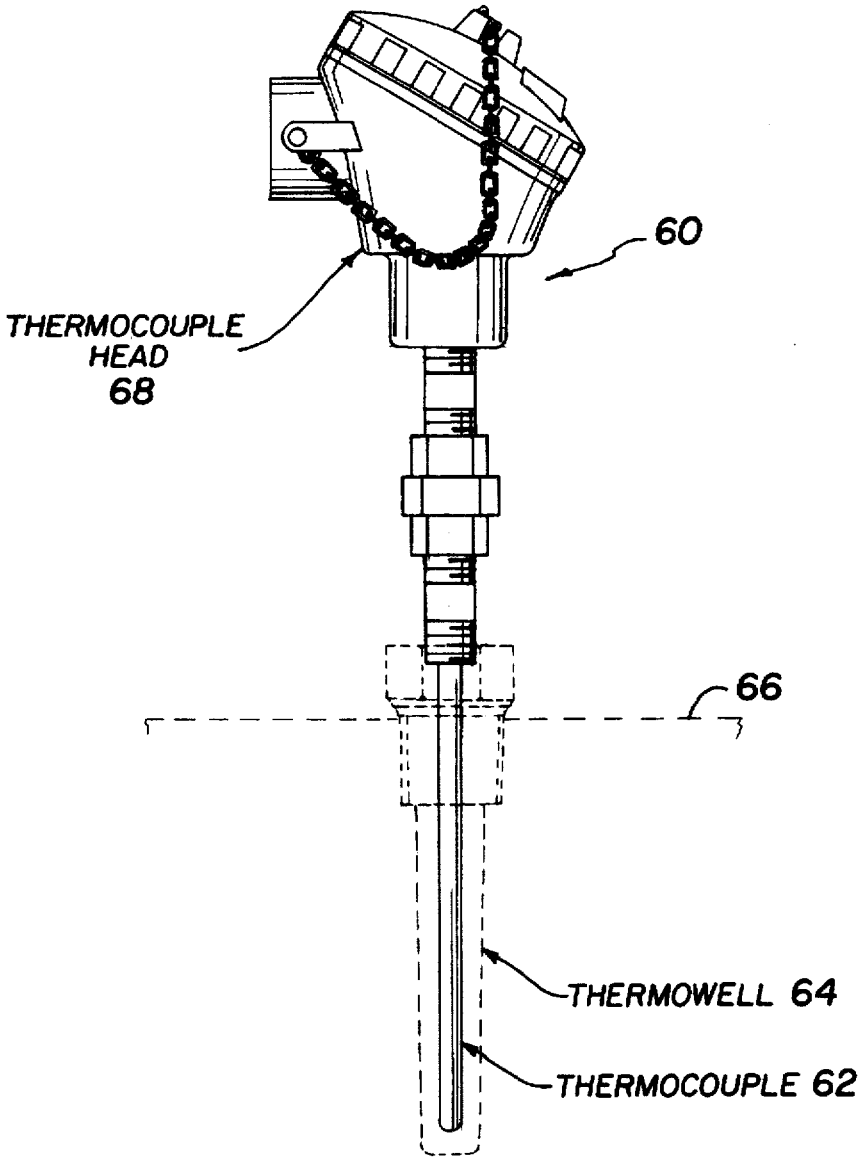
FIG. 6 is an enlarged cross-sectional view of a typical temperature detector 60 used in the preferred embodiments shown in FIGS. 1, 2, and 3.

FIG. 6 is an enlarged cross-sectional view of a typical temperature detector 60. Note that thermocouple 62 is actually positioned inside a sheath or funnel, which is called a thermowell 64, that protects thermocouple 62 from the steam or feed water being tested and is electrically coupled to thermocouple head 68 to the data acquisition system. Note the exterior surface 66 of the steam duct or feed water passageway in which the temperature detector 60 is positioned.

Figure 7:
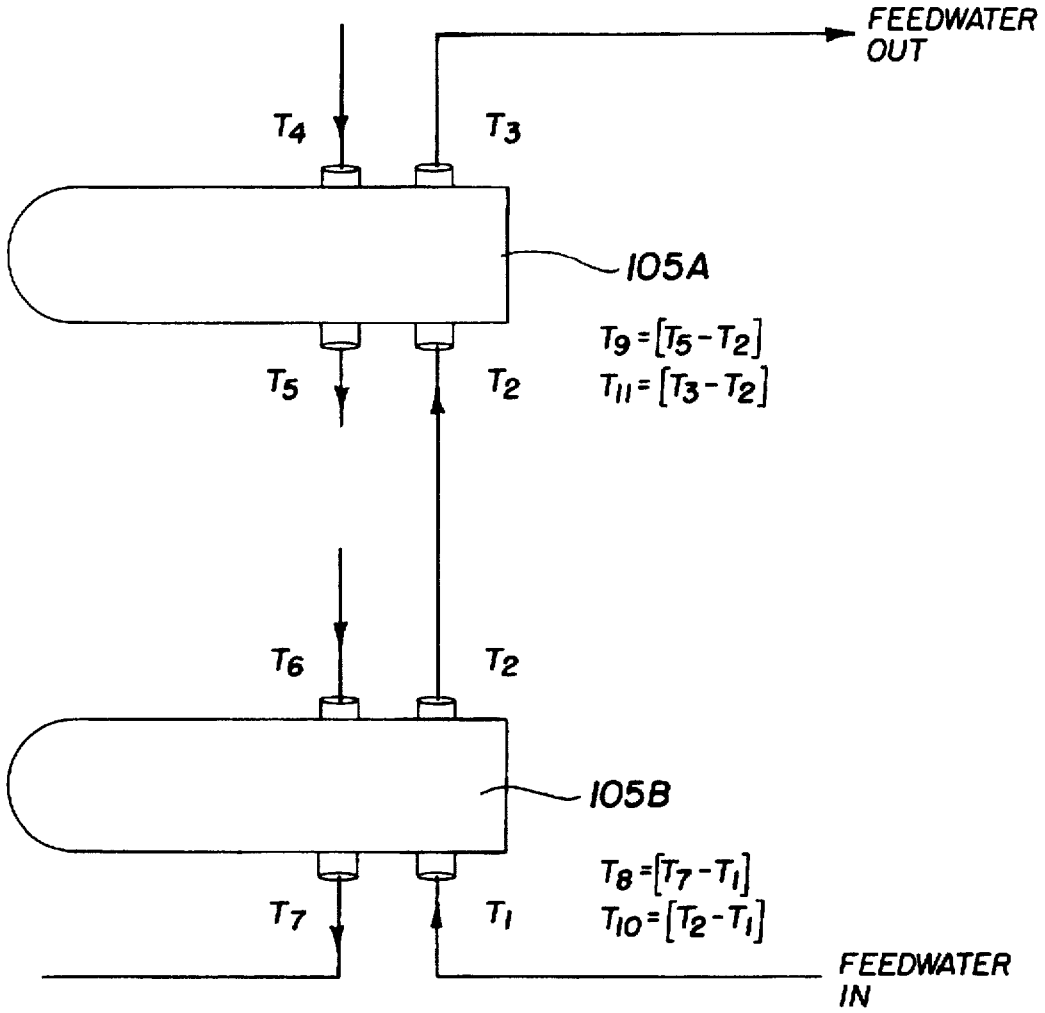
FIG. 7 is an enlarged view of cascaded high pressure feed water heaters 105 in FIGS. 1 and 2 and high pressure feed water heaters 105A and 105B in FIG. 3 with the temperature indicated at various locations.

FIG. 7 is an enlarged view of cascaded high pressure feed water heaters 105 in FIGS. 1 and 2 and high pressure feed water heaters 105A and 105B in FIG. 3 with the temperature indicated at various locations. Note that preferred embodiments focus on high pressure feed water heaters 105 to monitor the overall operation of the power plant and to especially provide an early warning of potential problems. This is important, because the potential differences in pressure between the condensation and steam in high pressure feed water heaters 105A and/or 105B are such that problems in these high pressure feed water heaters 105A and/or 105B have a significantly smaller response time during which power plant operators can take corrective action. In particular, as discussed above, the steam or condensation pressure in the high pressure feed water heater 105 is less than 600 psig, whereas the pressure of the feed water in the high pressure feed water heater 105 is greater than 4,000 psig, so excess feed water (e.g., from a leak in the U-tubes 418 of high pressure feed water heater 105A or 105B) easily overwhelms the steam being extracted from high pressure turbine 120 or intermediate pressure turbine 122 (in FIG. 3) and, therefore, can reach high pressure turbine 120 and/or intermediate pressure turbine 122 via the steam line(s) 60M or 60N (in FIG. 3) that are intended to carry the steam from high pressure turbine 120 and intermediate pressure turbine 122 to high pressure feed water heaters 105.

Referring again to FIGS. 3 and 7, $T_1$ corresponds to the temperature detected by temperature detector 60C of the feed water at feed water inlet 414 (in FIG. 4) of high pressure feed water heater 105B as the feed water enters high pressure feed water heaters 105. $T_2$ corresponds to the temperature detected by temperature detector 60B of the feed water at feed water outlet 416 (in FIG. 4) of high pressure feed water heater 105B as feed water leaves high pressure feed water heater 105B and subsequently enters high pressure feed water heater 105A via the feed water inlet 414 (in FIG. 4) of high pressure feed water heater 105A. $T_3$ corresponds to the temperature detected by temperature detector 60A of the feed water at feed water outlet 416 (in FIG. 4) of high pressure feed water heater 105A as the feed water leaves high pressure feed water heater 105A. $T_4$ corresponds to the temperature detected by temperature detector 60M of the extraction steam used to heat feed water in high pressure feed water heater 105A, as the extraction steam enters high pressure feed water heater 105A via steam inlet 410 (in FIG. 4). $T_5$ corresponds to the temperature detected by temperature detector 60S of the condensate drained from high pressure feed water heater 105A to high pressure feed water heater 105B, as condensation leaves high pressure feed water heater 105B via normal condensate drain and/or drain control valves. $T_6$ corresponds to the temperature detected by temperature detector 60N of the extraction steam used to heat feed water in high pressure feed water heater 105B, as the extraction steam enters high pressure feed water heater 105B via steam inlet 410 (in FIG. 4). $T_7$ corresponds to the temperature detected by temperature detector 60T of the heater drain used to heat feed water in high pressure feed water heater 105B, as the steam condensation leaves high pressure feed water heater 105B via the normal condensate drain and/or drain control valves to upstream deaerator 111. Differences in temperature are computed at various points throughout high pressure feed water heaters 105A and 105B to monitor the operation of high pressure feed water heaters 105A and 105B, individually and collectively. For instance, preferred embodiments calculate the difference in the temperature across high pressure feed water heater 105B (between $T_2$ and $T_1$, which is defined as $T_{10}$) and between $T_1$ and $T_7$, which is defined as $T_8$. Preferred embodiments also calculate the difference in temperature across high pressure feed water heater 105A (between $T_2$ and $T_3$, which is defined as $T_{11}$) and between $T_2$ and $T_5$, which is defined as $T_9$. In addition, these differences in temperature are also archived over time at a predefined interval (e.g., 2 seconds).

Figure 8:
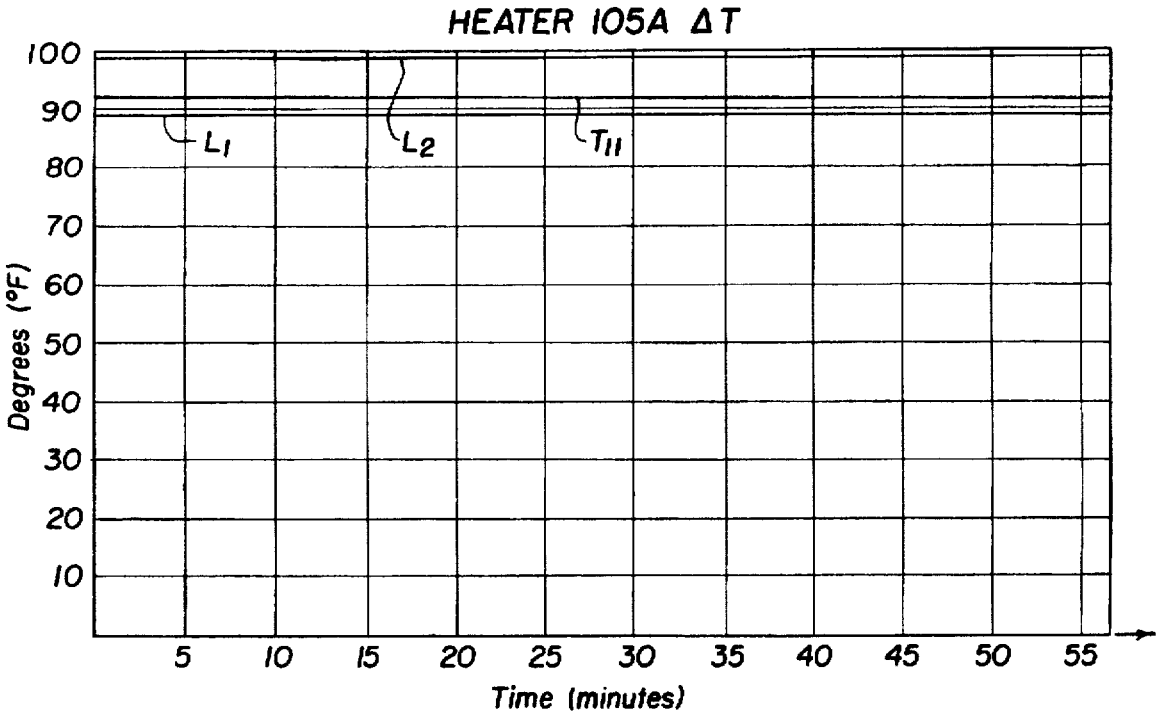
FIG. 8 is a real time graph showing the difference in temperature ($\Delta T$) for high pressure feed water heater 105A ($T_{11}$) in FIG. 7 over time in relation to two (2) limits $L_1$ and $L_2$.
Figure 11:
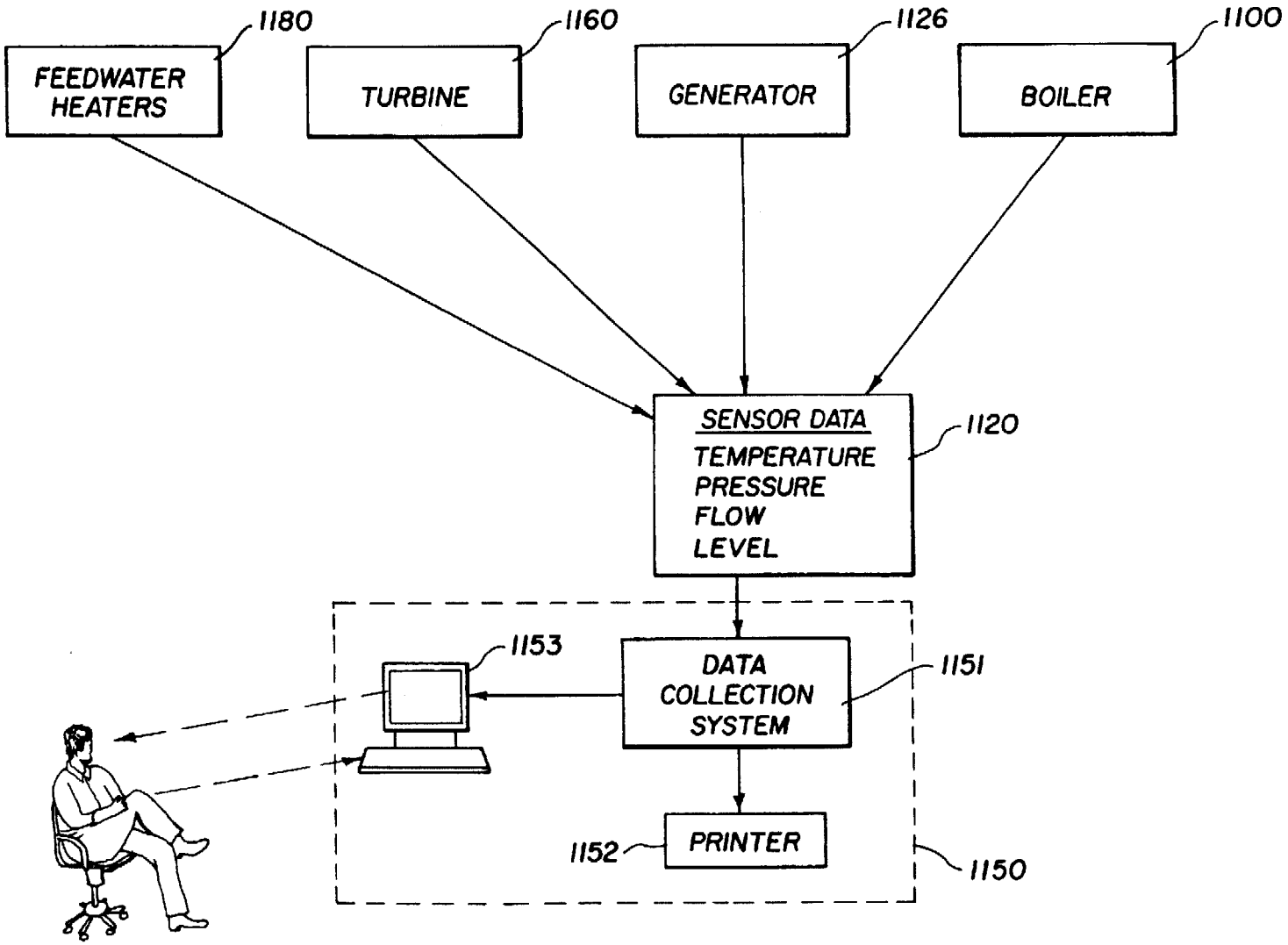
FIG. 11 is a system level configuration of a preferred data collection and gathering system, having data collection system 1151 to collect sensor data 1120.

FIG. 8 is a real time graph showing $T_{11}$, which is the difference across high pressure feed water heater 105A over time in relation to two limits $L_1$ and $L_2$. As discussed above, preferred embodiments determine the appropriate $T_{11}$ by reviewing system designs, manufacturer specifications, and imply historical readings from high pressure feed water heater 105A, which is, in this example, approximately 94° F. Then, a specified amount (e.g., 5° F.) was subtracted from and added to 94° F. to create $L_1$ (89° F.) and $L_2$ (99° F.). The end user may establish alternate appropriate $L_1$ and $L_2$ for the specific application. An example of preferred embodiments use a computer with the proper software to compare $T_{11}$ to $L_1$ and $L_2$ on an on-going basis (e.g., every two seconds) to determine whether high pressure heater 105A is working properly. Foxboro IA Distributed Control System is a preferred computerized data collection and gathering system 1150 (in FIG. 11) used, but alternate distributed control systems could be used. In addition, since Foxboro is equipped with computer hardware and software along with a printer(s) 1152, terminal(s) 1153, and data collection system 1151, the Foxboro system provides a way to collect and analyze the data collected in a real time fashion. FIG. 11 is a system level configuration of a preferred data collection and gathering system. Data collection system 1151 gathers sensor data 1120 associated with feed water heaters 1180, turbine 1160, generator 1126, and boiler 1100. Data collection system 1150 creates the graph shown in FIG. 8, $T_{11}$, $L_1$ and $L_2$, so that a plant operator can review the information on an on-going basis.

Figure 9A:
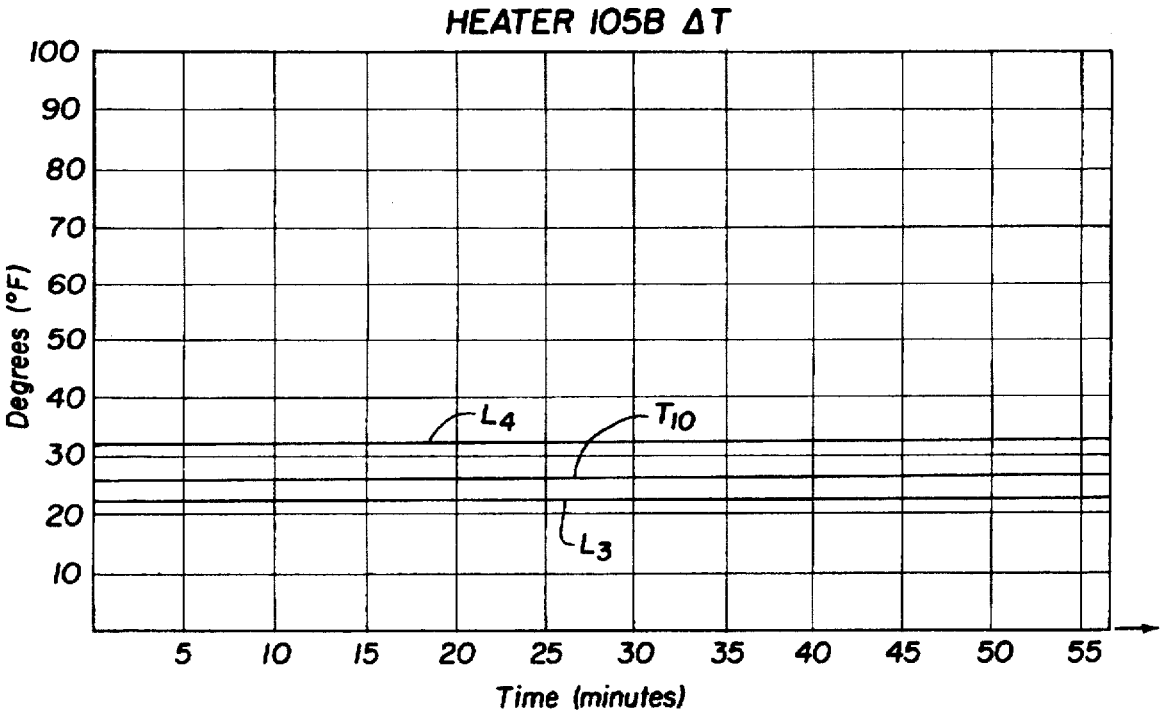
FIG. 9A is a real time graph showing the difference in temperature ($\Delta T$) for high pressure feed water heater 105B ($T_{10}$) in FIG. 7 over time in relation to two (2) limits $L_3$ and $L_4$.
Figure 9B:
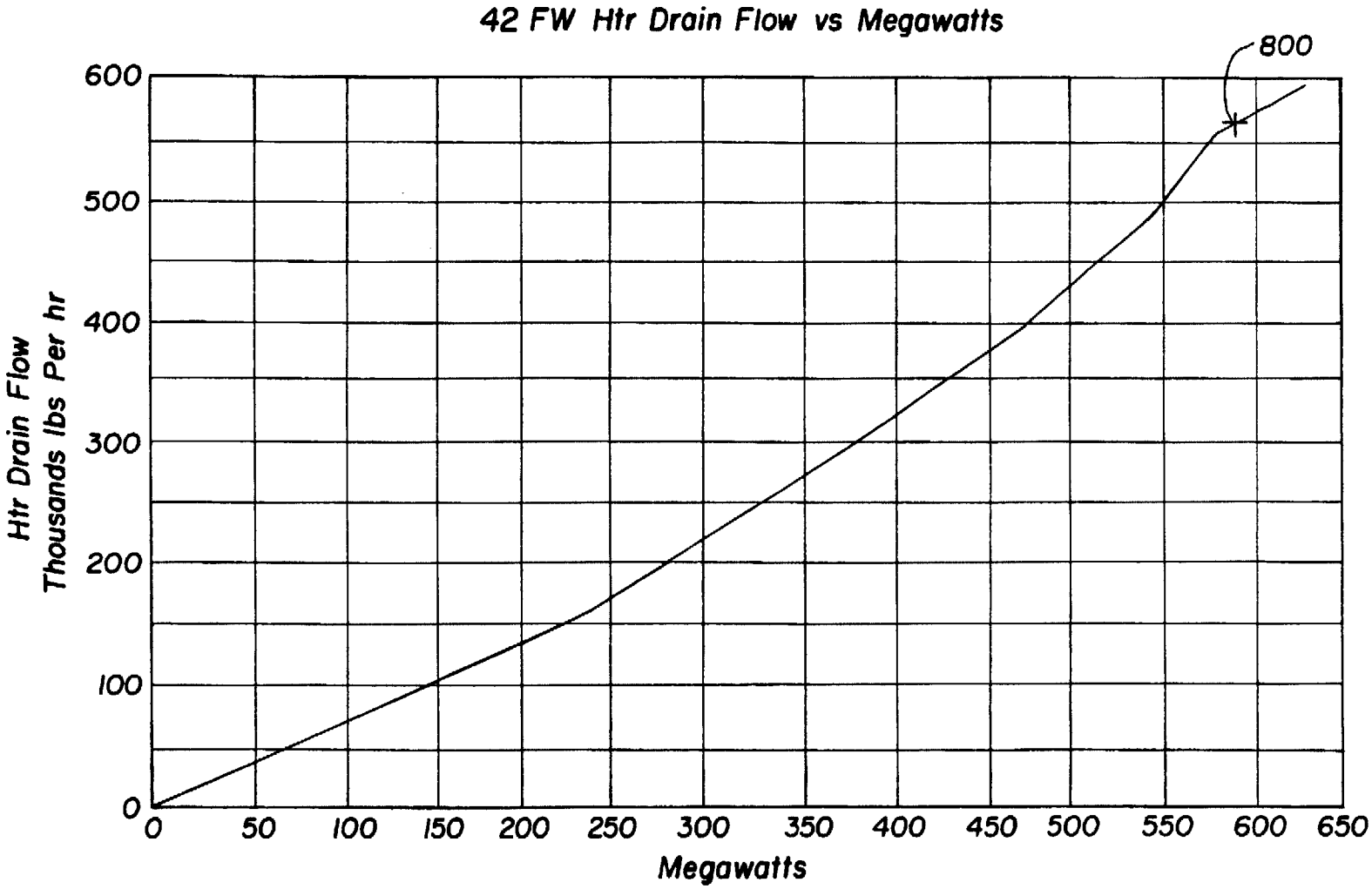
FIG. 9B is a graph of the drain flow for high pressure feed water heater 105B in FIG. 7 verses Megawatts, allowing comparison of predicted verses actual performance.
Figure 13:
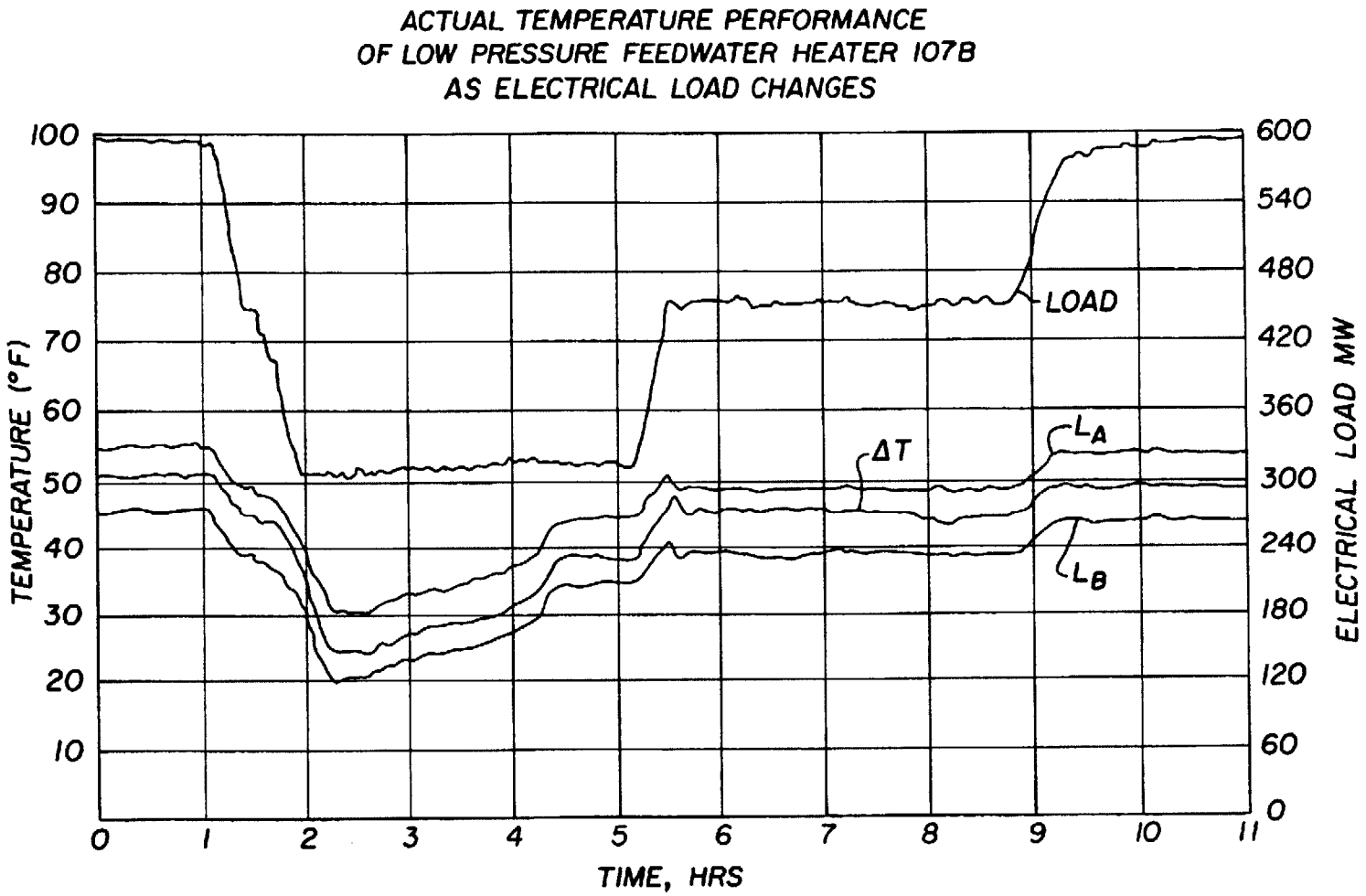
FIG. 13 is a graph of the actual temperature measurements corresponding to low pressure feed water heater 107D in the power plant shown in FIG. 3 showing the relationship between the electrical load (MW) and the difference (A) in the temperature across low pressure feed water heater 107D and the corresponding limits surrounding the difference (A) in the temperature across low pressure feed water heater 107B, as the electrical load changes.

Likewise, FIG. 9A is a real time graph showing the difference (A) in temperature for high pressure feed water heater 105B in FIG. 7 over time in relation to two limits $L_3$ and $L_4$. Once again, as discussed above, preferred embodiments determined the appropriate $T_{10}$ by reviewing system designs, manufacturer specifications, and historical readings from high pressure feed water heater 105B, which is approximately 28° F. Then, once again, a specified amount (5° F.) was subtracted off and added to 28° F. to create $L_3$ (23° F.) and $L_4$ (33° F.). Preferred embodiments use the FoxBoro system to compare $T_{10}$ to $L_3$ and $L_4$ on an on-going basis (every two seconds) to determine whether high pressure heater 105B is working properly. Foxboro creates the graph shown in FIG. 9A, and presents $T_{10}$, $L_3$ and $L_4$, so that the power plant operator can review the information on an on-going basis. Alternatively, as shown in FIG. 9B, alternate preferred embodiments could also graph the relationship between drain flow verses Megawatts and specify location 800, which is the sample corresponding to high pressure feed water heater 105B at a specific point in time. If high pressure feed water heaters 105A and 105B are operating correctly, the sample should reside somewhere on the relationship graphed in FIG. 9B. FIG. 9B is used in part to determine $L_3$ and $L_4$. Although not shown, please note that a graph similar to that shown in FIG. 9B could be created that corresponded to FIG. 8 and could be used in part to determine $L_1$ and $L_2$. Also, as shown in FIG. 13 in reference to low pressure feed water heater 107D, the standard difference (Δ) in the temperature and the corresponding limits surrounding the standard difference (Δ) in the temperature may vary as the electrical load changes.

If $T_{10}$ and/or $T_{11}$ (in FIGS. 9A and 9B, respectively) exceed their respective preset limits, it is an indication that high pressure feed water heater 105A and/or high pressure feed water heater 105B are not working correctly or that there might be excess of condensation therein. And, if there is excess water in high pressure feed water heater 105A and/or in high pressure feed water heater 105B, there is greater risk, if not an immediate danger, of there being feed water in the turbines. Consequently, drains, such as drain outlet 434 in FIG. 4, on high pressure feed water heater 105A and/or high pressure feed water heater 105B need to be opened to release any excess liquid. The power plant operator can directly open the drains or have them opened or, in some instances, an operating system, such as Foxboro, may automatically open the drains to release additional liquid. At any rate, the warning provided by monitoring the temperature is sufficiently earlier (and more reliable) than any warning provided by level detectors inside high pressure feed water heater 105A and/or high pressure feed water heater 105B (in FIG. 3) or other detectors or sensors in steam lines 121 or 123 (in FIG. 2) or in turbines 120, 122, or 124 (in FIGS. 1 and 2) themselves. However, these detectors and sensors do provide a secondary or back-up notification system.

FIGS. 10A and 10B show a graph of the $T_1$, $T_2$, $T_3$, $T_{10}$ and $T_{11}$ over time, as high pressure feed water heaters 105S and 105B operate normally and as one high pressure feed water heater, high pressure feed water heater 105B, is filled with liquid. Region 1001 corresponds to a typical transient condition. Region 1002 corresponds to a steady state condition when both high pressure feed water heaters 105A and 105B are operating correctly. Region 1003 corresponds to a condition when high pressure feed water heater 105B is filled with liquid. Note the speed and degree to which the temperature difference across high pressure feed water heater 105B, $T_{10}$, dropped. Also, as described above, note how the down-stream heater, high pressure feed water heater 105A, attempted to compensate for the effects of the excess liquid in high pressure feed water heater 105B. The difference across high pressure feed water heater 105A actually increased, as the incoming water temperature $T_2$ dropped and more steam was extracted from the turbine. Region 1004 corresponds to a condition in which drains were opened to drain excess liquid from high pressure heater 105B. Note both differences appeared to return to a normal operating range. Finally, region 1005 corresponds to another condition in which high pressure feed water heater 105B is again being filled with liquid and high pressure feed water heater 105A is attempting to compensate. Also, note that temperature detectors before and after each high pressure feed water heaters 105A and 105B are preferred, as shown in FIGS. 3 and 7, because temperature detectors before and after both high pressure feed water heaters 105 might not be able to detect a problem with one heater or locate the exact heater having the problem due to the interactive relationship of high pressure feed water heaters 105A and 105B shown in FIGS. 10A and 10B.

Note that the limits $L_1$, $L_2$, $L_3$, and $L_4$ are flexible and may need to be adjusted or recalibrated from time to time, as the operational characteristics of the high pressure feed water heaters 105 and/or of the feed water change. As discussed above, the operational characteristics of the high pressure feed water heaters 105 may change, as leaks are detected in a specific U-tube of U-tubes 418 and that specific U-tube 418 is sealed off. In addition, the outside temperature or the electrical load on the power plant may affect the operational characteristics of the high pressure feed water heaters 105 as well. Also, note that graphs similar to the graphs shown in FIGS. 8, 9A, and 9B can be created for low pressure feed water heaters 107 or other pieces of equipment. Similarly, FIG. 13 is a graph of the actual temperature measurements corresponding to low pressure feed water heater 107D in the power plant shown in FIG. 3 showing the relationship between the electrical load (MW) ("ELECTRICAL LOAD") and the difference in the temperature (Δ) (DT) across low pressure feed water heater 107D and the corresponding limits ($L_A$ and $L_B$)surrounding the difference in the temperature (Δ) across low pressure feed water heater 107B, as the electrical load changes.

Moreover, preferred embodiments take advantage of the realization that with plant design information (e.g., plant design heat balance calculations) and/or unit historical data, the expected temperature rise across each high pressure feed water heater 105 (in FIGS. 1 and 2) can be ascertained and accurately predicted. As shown in FIG. 12, with feed water flow, unit load, actual temperature rise for each heater, extraction steam pressures, and extraction steam condensation temperatures, heater performance can be calculated and audited against expected performance. When the preferred embodiment detects a variation of a predetermined magnitude between actual and expected performance, the power plant operator is alarmed by the plant data acquisition system. The power plant operator will respond by auditing the feed water heater process against design to determine the necessary action to remedy the situation.

FURTHER MODIFICATIONS AND VARIATIONS

Although the invention has been described with reference to a specific embodiment, this description is not meant to be construed in a limiting sense. The example embodiments shown and described above are only intended as an example. Various modifications of the disclosed embodiment as well as alternate embodiments of the invention will become apparent to persons skilled in the art upon reference to the description of the invention. For instance, while the preferred embodiment described above was described in reference to high pressure feed water heaters 105, the described techniques are preferably applied to other power plant equipment as well, especially other power plant equipment that is directly or indirectly coupled to at least one turbine, such as low pressure feed water heaters 107, auxiliary coolers 135, deaerator 111 (in FIGS. 1, 2, and 3). The systems and methods described above may also be applied to the high pressure turbines 120, intermediate pressure turbine 122, and low pressure turbine 124 themselves. In addition, alternate data collection and gathering systems may be used in place of or in lieu of the Foxboro System, such as a Honeywell or Bailey Distributed Control System.

Thus, even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used in the attached claims. Accordingly, it should be understood that the modifications and variations suggested above and below are not intended to be exhaustive. These examples help show the scope of the inventive concepts, which are covered in the appended claims. The appended claims are intended to cover these modifications and alternate embodiments.

In short, the description and drawings of the specific examples above are not intended to point out what an infringement of this patent would be, but are to provide at least one explanation of how to make and use the inventions contained herein. The limits of the inventions and the bounds of the patent protection are measured by and defined in the following claims.

What is claimed is:

1. A steam powered electric power generating station to provide electricity, comprising:

(a) a burner to process fuel to generate heat;

(b) a boiler which is heated by said heat to convert feed water into steam;

(c) a steam turbine that is connected to said boiler via a first steam line extending from said boiler to said steam turbine to receive said steam created by said boiler, said steam turns said steam turbine, said steam turbine powers an electrical generator, said electrical generator generates said electricity;

(d) a heater to heat said feed water generated from said steam remaining after said steam is condensed after turning said steam turbine, said heater to receive a portion of said steam from said steam turbine via a second steam line extending from said steam turbine to said heater to heat said feed water;

(e) a first temperature detector positioned to detect a first temperature of said feed water prior to being heated by said heater;

(f) a second temperature detector positioned to detect a second temperature of said feed water after being heated by said heater; and (g) a computer electrically coupled to said first temperature detector to receive said first temperature and to said second temperature detector to receive said second temperature, said computer compares said first temperature to said second temperature to generate a temperature difference and compares said temperature difference with a preferred temperature difference to determine whether excess amounts of condensation are present in said heater and in danger of reaching said steam turbine.

2. The steam powered electric power generating station of claim 1, wherein said computer compares said temperature difference with a second preferred temperature difference to determine whether said heater has an excess amount of condensation inside said heater.

3. The steam powered electric power generating station of claim 1, wherein said fuel is pulverized coal and said burner is adapted to burn said pulverized coal to process said fuel to generate said heat.

4. The steam powered electric power generating station of claim 1, wherein said fuel is lignite and said burner is adapted to bum said lignite to process said fuel to generate said heat.

5. The steam powered electrical power generating station of claim 1, further comprising:

(h) a first turbine temperature detector in said steam turbine electrically coupled to said computer, said first turbine temperature detector in said steam turbine activated when condensation in said steam turbine reaches a first turbine temperature, said computer monitors said turbine temperature level detector and triggers a warning signal to a plant operator monitoring said steam powered electrical power generating station when said first turbine temperature detector is activated.

6. The steam powered electrical power generating station of claim 1, further comprising:

(h) a first level detector in said heater electrically coupled to said computer, said first level detector in said heater activated when condensation in said heater reaches a first level, said computer monitors said first level detector and triggers a warning signal to a plant operator monitoring said steam powered electrical power generating station when said first level detector is activated.

7. The steam powered electrical power generating station of claim 1, further comprising;

(h) a third temperature detector positioned in said second steam line to detect a temperature of said steam being transported to said heater via said second steam line, said third temperature detector electrically coupled to said computer, said computer compares a third temperature detected from said third temperature detector to a standard temperature to determine if steam is being transported via said second steam line and whether condensation is present in said second steam line.

8. The steam powered electrical power generating station of claim 1, wherein said first temperature detector periodically detects said first temperature at a first interval.

9. The steam powered electrical power generating station of claim 8, wherein said first interval is two seconds.

10. The steam powered electrical power generating station of claim 8, wherein said second temperature detector periodically detects said second temperature at a second interval.

11. The steam powered electrical power generating station of claim 10, wherein said first interval and said second interval are approximately equal to one another.

12. A steam powered electric power generating station to provide electricity, comprising:

(a) a steam turbine positioned in a steam turbine shell, said steam turbine having at least one blade and a shaft joined to said at least one blade, said shaft adapted to turn an electrical generator to create electricity, said steam turbine shell adapted to receive steam to turn said at least one blade and said shaft of said steam turbine via a first steam line connected to said steam turbine shell;

(b) equipment connected to said steam turbine shell to receive steam from said steam turbine shell via a second steam line extending from said steam turbine shell to said equipment, said equipment receives feed water through an entry port and releases feed heater through an exit port, said equipment performs certain operations on said feed water;

(c) a first temperature detector positioned to detect a first temperature of said feed water prior to entering said equipment via said entry port;

(d) a second temperature detector positioned to detect a second temperature of said feed water after exiting said equipment via said exit port; and (e) a computer electrically coupled to said first temperature detector to receive said first temperature and to said second temperature detector to receive said second temperature, said computer compares said first temperature to said second temperature to generate a temperature difference and compares said temperature difference with a standard temperature difference to determine whether excess amounts of condensation are present in said equipment and In danger of entering said steam turbine shell.

13. The steam powered electric power generating station of claim 12, wherein said computer also determines whether said equipment is operating correctly.

14. The steam powered electric power generating station of claim 12, further comprising:

(f) a burner to process fuel to generate heat; and (g) a boiler which is heated be said heat to convert feed water into said steam, wherein said steam is transported to said steam turbine via said first steam line.

15. The steam powered electric power generating station of claim 14, wherein said fuel is pulverized coal and said burner is adapted to bum said pulverized coal to process said fuel to generate said heat.

16. The steam powered electric power generating station of claim 14, wherein said fuel is lignite and said burner is adapted to bum said lignite to process said fuel to generate said heat.

17. The steam powered electrical power generating station of claim 12, further comprising:

(h) a first turbine temperature detector in said steam turbine shell that is electrically coupled to said computer, said first turbine temperature detector in said steam turbine shell is activated when condensation in said steam turbine shell reaches a first turbine temperature, said computer monitors said first turbine temperature detector and triggers a warning signal to a plant operator monitoring said steam powered electrical power generating station when said first turbine temperature detector is activated.

18. The steam powered electrical power generating station of claim 12, further comprising:

(h) a first level detector in said equipment that is electrically coupled to said computer, said first level detector in said equipment is activated when condensation in said equipment reaches a first level, said computer monitors said first level detector and triggers a warning signal to a plant operator monitoring said steam powered electrical power generating station when said first level detector is activated.

19. The steam powered electrical power generating station of claim 12, further comprising:

(h) a third temperature detector positioned in said second steam line to detect a temperature of said steam being transported to said equipment from said steam turbine shell via said second steam line, said third temperature detector electrically coupled to said computer, so that said computer receives said third temperature, said computer compares a third temperature detected from said third temperature detector to a standard temperature to determine whether or not condensation is in said second steam line.

20. The steam powered electrical power generating station of claim 19, further wherein said computer, monitors said third temperature and triggers a warning signal to a plant operator monitoring said steam powered electrical power generating station.

21. The steam powered electrical power generating station of claim 12, wherein said first temperature detector periodically detects said first temperature at a first interval.

22. The steam powered electrical power generating station of claim 21, wherein said first interval is two seconds.

23. The steam powered electrical power generating station of claim 21, wherein said second temperature detector periodically detects said second temperature at a second interval.

24. The steam powered electrical power generating station of claim 23, wherein said first interval and said second interval are approximately equal to one another.

25. The steam powered electrical power generating station of claim 12, wherein said equipment is selected from a low pressure feed water heater, a high pressure feed water heater, and a deaerator, and an auxiliary coolers condenser.

26. A process of alerting the power plant operator of a hazardous condition, comprising:

(a) detecting a first temperature of feed water immediately before said feed water enters heating equipment;

(b) detecting a second temperature of said feed water immediately after said feed water exits said heating equipment;

(c) comparing said first temperature to said second temperature to generate a temperature difference between said first temperature and said second temperature;

(d) comparing said temperature difference with a preferred temperature difference to determine whether excess amounts of condensation are present in said heating equipment and in danger of reaching said steam turbine, and (e) generating a warning signal to alert said power plant operator that excess amounts of condensation are present in said heating equipment and in danger of reaching said steam turbine.

27. The process of claim 26, further comprising:

(f) detecting a condensation level within said heating equipment;

(g) comparing said condensation level with a preferred condensation level to determine whether said condensation level exceeds said preferred condensation level to determine whether condensation is in danger of reaching said steam turbine; and (h) generating a warning signal to alert said power plant operator if said condensation level exceeds said preferred condensation level.

28. The process of claim 26, wherein said heating equipment utilizes steam to heat said feed water, wherein said heating equipment receives said steam from a steam turbine via a steam line.

29. The process of claim 28, further comprising:

(f) detecting a third temperature of said steam in said steam line; and (g) comparing said third temperature to a standard temperature to determine if steam is being transported via said steam line and whether condensation is present in said steam line and in danger of reaching said steam turbine.

30. The process of claim 26, wherein said first temperature is periodically detected at a first interval and said second temperature is periodically detected at a second interval.

31. The process of claim 30, wherein said first interval and said second interval are equal to two seconds.

32. The process of claim 26, said preferred temperature difference is determined by modeling said heating equipment.

33. The process of claim 26, wherein said equipment is selected from a low pressure feed water heater, a high pressure feed water heater, an auxiliary cooler condenser, and a deaerator.

* * * * *